US006393247B1

(12) United States Patent
Chen et al.

(10) Patent No.: US 6,393,247 B1
(45) Date of Patent: May 21, 2002

(54) TONER FUSING STATION HAVING AN INTERNALLY HEATED FUSER ROLLER

(75) Inventors: Jiann-Hsing Chen, Fairport; Arun Chowdry, Rochester; James E. Mathers, Rochester; John W. May, Rochester; Borden H. Mills, Webster; Alan R. Priebe; Kenneth D. Stack, both of Rochester, all of NY (US)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 09/680,135

(22) Filed: Oct. 4, 2000

(51) Int. Cl.[7] ..... G03G 15/20

(52) U.S. Cl. ..... 399/330; 399/331; 399/333; 492/53; 492/56

(58) Field of Search ..... 399/328, 330, 399/331, 332, 333, 334, 335, 339; 219/216, 469; 430/99, 124; 347/156; 492/49, 53, 56; 29/895, 895.21; 428/447

(56) References Cited

U.S. PATENT DOCUMENTS

| | | | | |
|---|---|---|---|---|
| 3,863,603 A | | 2/1975 | Beckley et al. | 118/637 |
| 3,959,574 A | | 5/1976 | Seanor et al. | 428/425 |
| 3,983,287 A | | 9/1976 | Goosen et al. | 428/241 |
| 4,023,967 A | | 5/1977 | McGibbon | 96/1 LY |
| 4,255,508 A | | 3/1981 | Kuehnle | 430/94 |
| 4,378,622 A | | 4/1983 | Pinkston et al. | 29/148.4 D |
| 4,531,825 A | | 7/1985 | Miwa et al. | 399/308 |
| 4,601,963 A | | 7/1986 | Takahashi et al. | 430/69 |
| 4,791,275 A | | 12/1988 | Lee et al. | 219/469 |
| 4,899,197 A | | 2/1990 | Davis et al. | 399/326 |
| 5,038,178 A | | 8/1991 | Hosoya et al. | 399/313 |
| 5,124,756 A | * | 6/1992 | Stelter | 399/333 X |
| 5,143,573 A | | 9/1992 | Ammon et al. | 156/294 |
| 5,227,853 A | | 7/1993 | Prouix et al. | 399/339 |
| 5,258,809 A | | 11/1993 | Wiedemer | 399/112 |
| 5,298,956 A | | 3/1994 | Mammino et al. | 399/308 |
| 5,335,054 A | | 8/1994 | Lands et al. | 399/308 |
| 5,376,999 A | | 12/1994 | Hwang | 399/299 |
| 5,386,273 A | | 1/1995 | Wood et al. | 399/116 |
| 5,415,961 A | | 5/1995 | Yu et al. | 430/58 |
| 5,418,600 A | | 5/1995 | Genovese | 399/167 |
| 5,438,398 A | | 8/1995 | Tanigawa et al. | 399/302 |
| 5,497,222 A | | 3/1996 | Landa et al. | 399/308 |
| 5,508,789 A | | 4/1996 | Castelli et al. | 399/8 |
| 5,519,475 A | | 5/1996 | Miyamoto et al. | 399/308 |
| 5,553,541 A | | 9/1996 | Vrotacoe et al. | 101/217 |
| 5,592,269 A | | 1/1997 | Youses et al. | 399/237 |
| 5,636,349 A | | 6/1997 | Landa et al. | 399/307 |
| 5,669,045 A | | 9/1997 | Swain | 399/159 |
| 5,704,291 A | | 1/1998 | Lewis | 101/457 |
| 5,722,016 A | | 2/1998 | Godlove et al. | 399/159 |
| 5,745,829 A | | 4/1998 | Gazit et al. | 399/302 |
| 5,790,930 A | | 8/1998 | Fuschiwald | 399/302 |
| 5,894,796 A | | 4/1999 | Gelions | 101/219 |
| 5,946,525 A | | 8/1999 | Okamura et al. | 399/66 |
| 5,960,245 A | * | 9/1999 | Chen et al. | 399/333 |
| 6,044,243 A | | 3/2000 | Hara | 399/302 |
| 6,075,965 A | | 6/2000 | Tombs et al. | 399/308 |

FOREIGN PATENT DOCUMENTS

| | | |
|---|---|---|
| EP | 0 590 924 A1 | 9/1993 |
| EP | 0 928 999 A2 | 1/1999 |
| JP | 3133695 | 6/1991 |
| JP | Hei 81996-114997 | 5/1996 |
| WO | WO 98/04961 | 2/1998 |

* cited by examiner

*Primary Examiner*—Sophia S. Chen
*Assistant Examiner*—Hoan Tran
(74) *Attorney, Agent, or Firm*—James D. Leimbach

(57) ABSTRACT

A product and process for forming an internally heated roller configuration for use in an electrostatographic machine that employs a fuser roller and a pressure roller. One of the rollers is a conformable roller having a rigid cylindrical core member centered on an axis of rotation, a compliant base cushion layer formed on the core member; a stiffening layer in intimate contact with and surrounding the base cushion layer; and an internal heating mechanism, while the other roller is a hard roller.

25 Claims, 9 Drawing Sheets

TONER FUSING STATION HAVING AN INTERNALLY HEATED FUSER ROLLER

CROSS REFERENCE TO RELATED APPLICATION

Reference is made to the commonly assigned U.S. Patent Applications, the disclosures of which are incorporated herein by reference.

U.S. patent application Ser. No. 09/679,016, filed Oct. 4, 2000, in the names of Arun Chowdry et al, entitled DOUBLE-SLEEVED ELECTROSTATOGRAPHIC ROLLER AND METHOD OF USING.

U.S. patent application Ser. No. 09/679,113, filed Oct. 4, 2000, in the names of Robert Charlebois et al, entitled INTERMEDIATE TRANSFER MEMBER HAVING A STIFFENING LAYER AND METHOD OF USING.

U.S. patent application Ser. No. 09/679,177, filed Oct. 4, 2000, in the names of Muhammed Aslam et al, entitled SLEEVED ROLLERS FOR USE IN A FUSING STATION EMPLOYING AN INTERNALLY HEATED FUSER ROLLER.

U.S. patent application Ser. No. 09/679,345, filed Oct. 4, 2000, in the names of Jiann-Hsing Chen et al, entitled EXTERNALLY HEATED DEFORMABLE FUSER ROLLER.

U.S. patent application Ser. No. 09/680,133, filed Oct. 4, 2000, in the names of Arun Chowdry et al, entitled SLEEVED PHOTOCONDUCTIVE MEMBER AND METHOD OF MAKING.

U.S. patent application Ser. No. 09/680,134, filed Oct. 4, 2000, in the names of Muhammed Aslam et al, entitled SLEEVED ROLLERS FOR USE IN A FUSING STATION EMPLOYING AN EXTERNALLY HEATED FUSER ROLLER.

U.S. patent application Ser. No. 09/680,136, filed Oct. 4, 2000, in the names of Arun Chowdry et al, entitled IMPROVED INTERMEDIATE TRANSFER MEMBER.

U.S. patent application Ser. No. 09/680,139, filed Oct. 4, 2000, in the names of Robert Charlebois et al, entitled INTERMEDIATE TRANSFER MEMBER WITH A REPLACEABLE SLEEVE AND METHOD OF USING SAME.

U.S. patent application Ser. No. 09/680,138, filed Oct. 4, 2000, in the names of Jiann-Hsing Chen et al, entitled TONER FUSING STATION HAVING AN EXTERNALLY HEATED FUSER ROLLER.

FIELD OF THE INVENTION

This invention relates in general to electrosatatographic imaging and, more particularly, to fusing stations and rollers useful for color imaging having a stiffening layer included within an internally-heated, compliant toner fuser roller used with a compliant pressure roller.

BACKGROUND OF THE INVENTION

In electrostatographic imaging and recording processes such as electrophotographic reproduction, an electrostatic latent image is formed on a primary image-forming member such as a photoconductive surface and is developed with a thermoplastic toner powder to form a toner image. The toner image is thereafter transferred to a receiver, e.g., a sheet of paper or plastic, and the toner image is subsequently fused to the receiver in a fusing station using heat or pressure, or both heat and pressure. The fuser member can be a roller, belt, or any surface having a suitable shape for fixing thermoplastic toner powder to the receiver. The fusing step in a roller fuser commonly consists of passing the toned receiver between a pair of engaged rollers that produce an area of pressure contact known as a fusing nip. In order to form said nip, at least one of the rollers typically has a compliant or conformable layer on its surface. Heat is transferred from at least one of the rollers to the toner in the fusing nip, causing the toner to partially melt and attach to the receiver. In the case where the fuser member is a heated roller, a resilient compliant layer having a smooth surface is typically used which is bonded either directly or indirectly to the core of the roller. Where the fuser member is in the form of a belt, e.g., a flexible endless belt that passes around the heated roller, it typically has a smooth, hardened outer surface.

Most roller fusers, known as simplex fusers, attach toner to only one side of the receiver at a time. In this type of fuser, the roller that contacts the unfused toner is commonly known as the fuser roller and is usually the heated roller. The roller that contacts the other side of the receiver is known as the pressure roller and is usually unheated. Either or both rollers can have a compliant layer on or near the surface. In most fusing stations having a fuser roller and an engaged pressure roller, it is common for only one of the two rollers to be driven rotatably by an external source. The other roller is then driven rotatably by frictional contact.

In a duplex fusing station, which is less common, two toner images are simultaneously attached, one to each side of a receiver passing through a fusing nip. In such a duplex fusing station there is no real distinction between fuser roller and pressure roller, both rollers performing similar functions, i.e., providing heat and pressure.

Two basic types of simplex heated roller fusers have evolved. One uses a conformable, or compliant, pressure roller to form the fusing nip against a hard fuser roller, such as in a Docutech 135 machine made by the Xerox Corporation. The other uses a compliant fuser roller to form the nip against a hard or relatively non-conformable pressure roller, such as in a Digimaster 9110 machine made by Heidelberg Digital LLC. A fuser roller designated herein as compliant, typically includes a conformable layer having a thickness greater than about 2 mm and in some cases exceeding 25 mm. A fuser roller designated herein as hard, includes a rigid cylinder which can have a relatively thin polymeric or conformable elastomeric coating, typically less than about 1.25 mm thick. A fuser roller used in conjunction with a hard pressure roller tends to provide easier release of a receiver from the heated fuser roller, because the distorted shape of the compliant surface in the nip tends to bend the receiver towards the relatively non-conformable pressure roller and away from the much more conformable fuser roller.

A conventional toner fuser roller includes a cylindrical core member, often metallic such as aluminum, coated with one or more synthetic layers which typically include polymeric materials made from elastomers.

The most common type of fuser roller is internally heated, i.e., a source of heat is provided within the roller for fusing. Such a fuser roller normally has a hollow core, inside of which is located a heating source, usually a lamp. Surrounding the core is an elastomeric layer through which heat is conducted from the core to the surface, and the elastomeric layer typically contains fillers for enhanced thermal conductivity. A different kind of fuser roller which is internally heated near its surface is disclosed by Lee et al. in U.S. Pat. No. 4,791,275, which describes a fuser roller including two polyimide Kapton® sheets (sold by DuPont and Nemours) having a flexible ohmic heating element disposed between the sheets. The polyimide sheets surround a conformable polyirmide foam layer attached to a core member. According to J. H. DuBois and F. W. John, Eds., in *Plastics*, 5th Edition, Van Nostrand and Rheinhold, 1974, polyimide at room temperature is fairly stiff with a Young's modulus of about 3.5 GPa–5.5 GPa (1 GPa=1 GigaPascal=$10^9$ Newton/$m^2$), but the Young's modulus of the polyimide sheets can be expected to be considerably lower at the stated high operational fusing temperature of the roller of at least 450° F.

An externally heated fuser roller is used, for example, in an Image Source 120 copier, marketed by Eastman Kodak Company, and is heated by surface contact between the fuser roller and one or more heating rollers. Externally heated fuser rollers are also disclosed by O'Leary, U.S. Pat. No. 5,450,183, and by Derimiggio et al., U.S. Pat. No. 4,984,027.

A compliant fuser roller can include a conformable layer of any useful material, such as for example a substantially incompressible elastomer, i.e., having a Poisson's ratio approaching 0.5. A substantially incompressible conformable layer including a poly(dimethyl siloxane) elastomer has been disclosed by Chen et al. in U.S. patent application Ser. No. 08/879,896, which is hereby incorporated by reference. Alternatively, the conformable layer can include a relatively compressible foam having a value of Poisson's ratio much lower than 0.5. A conformable polyimide foam layer is disclosed by Lee in U.S. Pat. No. 4,791,275, and a lithographic printing blanket is disclosed by Goosen et al. in U.S. Pat. No. 3,983,287, including a conformable layer containing a vast number of frangible rigid-walled tiny bubbles which are mechanically ruptured to roduce a closed cell foam having a smooth surface.

Receivers remove the majority of heat during fusing. Since receivers can have a narrower length measured parallel to the fuser roller axis than the fuser roller length, heat can be removed differentially, causing areas of higher temperature or lower temperature along the fuser roller surface parallel to the roller axis. Higher or lower temperatures can cause excessive toner offset in roller fusers. However, if differential heat can be transferred axially along the fuser roller by layers within the fuser roller having high thermal conductivity, the effect of differential heating can be reduced.

Improved heat transfer from the core to the surface of an internally heated roller fuser will reduce the temperature of the core as well as that of mounting hardware and bearings that are attached to the core. Similarly, improved heat transfer to the surface of an externally heated fuser roller from external heating rollers will reduce the temperature of the external heating rollers as well as the mounting hardware and bearings attached to the external heating rollers.

When the fuser and pressure rollers of a simplex fusing station are pressed against each other, and the conformable layer is deflected to form the fusing nip, the thickness of the conformable layer is reduced inside the nip. When the conformable layer is substantially incompressible, the average speed of the conformable layer through the fusing nip must be greater than that of other parts of the conformable layer that are well away from the nip, because the volume flow rate of the elastomer is constant around the roller. This results in a surface speed of the conformable roller inside the nip which is faster than far away from the nip. When, for example, the conformable roller is a driving roller frictionally rotating a relatively non-conformable pressure roller, the pressure roller will rotate faster than if the fuser roller had been non-compliant, a phenomenon known as "overdrive". Overdrive can be expressed quantitatively as a peripheral speed ratio, measured as the ratio of the peripheral surface speeds far away from the nip.

A substantially incompressible elastomer that is displaced in the fusing nip results in an extra thickness of the conformable layer adjacent to either side of the fusing nip, i.e., pre-nip and post-nip bulges. Again, since the elastomer is substantially incompressible, the average speed of the conformable layer in these bulges is less than that of the other parts of the conformable layer that are well away from the nip. The highest pressure in the nip will be obtained at the center of the nip (at the intersection of the joined surfaces and an imaginary line between the centers of the two rollers). Since one roller drives the other, the surface velocities of the rollers should be close to equal at the point of maximum pressure, at the center of the nip. In view of these facts, it can be understood that in general there will be locations in the contact zone of the nip where the surface velocities of the two rollers differ, i.e., there will be slippage. This slippage, which can be substantial just after entry and just before exit of the nip, is a cause of wear which shortens roller life.

A potentially serious problem for fusing arising from the presence of overdrive is "differential overdrive", associated for example with tolerance errors in mounting the rollers forming the fusing nip, or with roller runout. Runout can have many causes, e.g., fluctuations in layer thicknesses along the length of a roller, variations in the dimensions of a core member, an acentric roller axis, and so forth. It will be evident that differential overdrive can result in localized differential slippages along the length of a fusing nip, inasmuch as the local effective speed ratio would otherwise tend to fluctuate or change with time along the length of the nip, causing some portions of the driven roller to try to lag and other portions to try to move faster than the average driven speed. Differential overdrive can have serious consequences for fusing, including the formation of large scale image defects and wrinkling of a receiver.

All rollers suffer from surface wear, especially where the edges of receivers contact the rollers. Since relative motion due to slippage between rollers increases wear, the changes in velocity of the surface of a conformable roller, as it travels into, through, and out of a fusing nip formed with a relatively non-conformable roller, should increase the wear rate of the conformable roller, especially if the conformable roller is the heated fusing member, bearing in mind that a fuser roller typically faces a relatively rough and abrasive paper surface in the nip. Moreover, since the material on the conformable roller is stretched and relaxed each time it passes through the fusing nip, this flexure can result in fatigue aging and wear, including failure of the roller due to splitting or cracking of the compliant material, or even delamination.

To obtain high quality electrophotographic copier/printer image quality, image defects must be reduced. One type of defect is produced by smearing of image dots or other small-scale image features in the fusing nip. Relative motions associated with overdrive and resulting in localized slippage between rollers in a fusing nip can cause softened toner particles to smear parallel to the direction of motion, resulting for example in elongated dots.

Some roller fusers rely on film splitting of low viscosity oil to enable release of the toner and (hence) receiver from the fuser roller. Relative motion in the fusing nip can disadvantageously disrupt the oil film.

The Kodak Ektaprint 3100 Copier/Duplicator and the Kodak 1392 Printer both have a fusing station using a compliant fuser roller having 4 cylindrical layers including a buried fluoroelastomeric layer, plus a relatively non-compliant pressure roller. Attached to a cylindrical aluminum core of the fuser roller is a filled silicone rubber conformable layer approximately 2.3 mm thick. Attached to the conformable layer is a fluorelastomeric layer 0.025 mm thick, surrounded by a surface layer approximately 0.23 mm thick made of the same filled silicone rubber as the conformable layer. The fluoroelastomeric layer prevents degradative absorption of release oil from the surface layer into the conformable layer. The surface velocity of the conformable fuser roller far away from the nip is less than that of the relatively non-conformable pressure roller, which is a measure of overdrive. The amount of overdrive is not noticeably different from that produced by a similar compliant roller which lacks the fluoroelastomeric layer.

A toner fuser roller commonly includes a hollow cylindrical core, often metallic, that typically has a heating source in its interior. A resilient base cushion layer, which can contain filler particles to improve mechanical strength and/or thermal conductivity, is formed on the surface of the core, which can advantageously be coated with a primer to improve adhesion of the resilient layer. Roller cushion layers are commonly made of silicone rubbers or silicone polymers such as, for example, poly(dimethylsiloxane) (PDMS) polymers of low surface energy, which minimize adherence of toner to the roller.

Frequently, release oils composed of, for example, poly (dimethylsiloxanes) are also applied to the fuser roller surface to prevent the toner from adhering to the roller. Such release oils (commonly referred to as fuser oils) can interact with the PDMS in the resilient layer upon repeated use, which in time causes swelling, softening, and degradation of the roller. To prevent these deleterious effects caused by release oil, a thin barrier layer of, for example, a cured polyfluorocarbon, is formed on the cushion layer.

Electrophotography can be used to create high quality multicolor toner images when the toner particles are small, that is, diameters less than 10 micrometers, and the receivers, typically papers, are smooth. A typical method of making a multicolor toner image involves trichromatic color synthesis by subtractive color formation. In such synthesis, successive imagewise electrostatic images, each representing a different color, are formed on a photoconductive element, and each image is developed with a toner of a different color. Typically, the colors correspond to each of the three subtractive primary colors (cyan, magenta and yellow) and, optionally, black. The imagewise electrostatic images for each of the colors can be made successively on the photoconductive element by using filters to produce color separations corresponding to the colors in the image. Following development of the color separations, each developed separation image can be transferred from the photoconductive element successively in registration with the other color toner images to an intermediate transfer member. All the color toner images can then be transferred in one step from the intermediate transfer member to a receiver, where they are fixed or fused to produce a multicolor permanent image. Alternatively, an electrophotographic apparatus including a series of tandem modules can be employed, such as disclosed in U.S. patent application Ser. No. 09/199,896, filed in the names of Herrick et al., wherein color separation images are formed in each of four color modules and transferred in register to a receiver member as the receiver member is moved through the apparatus while supported on a transport web.

To rival the photographic quality produced using silver halide technology, it is desirable that these multicolor toner images have high gloss. To this end, it is desirable to provide a very smooth fusing member contacting the toner particles in the fusing station.

In the fusing of the toner image to the receiver, the area of contact of a conformable fuser roller with the toner-bearing surface of a receiver sheet as it passes through the fusing nip is determined by the amount pressure exerted by the pressure roller and by the characteristics of the resilient cushion layer. The extent of the contact area helps establish the length of time that any given portion of the toner image will be in contact with and heated by the fuser roller.

A fuser module is disclosed by M. E. Beard et al., in U.S. Pat. No. 6,016,409, which includes an electronically-readable memory permanently associated with the module, whereby the control system of the printing apparatus reads out codes from the electronically readable memory at install to obtain parameters for operating the module, such as maximum web use, voltage and temperature requirements, and thermistor calibration parameters.

A well known problem in fusing is that paper receiver sheets can not be perfectly rectangular, as a result of humidity-induced swelling. After manufacture, paper sheets are typically stacked and conditioned in a humidity controlled environment. During this time, moisture partially penetrates the paper through the edges of the sheets. For typical commercial paper used in electrophotographic machines, moisture penetration is much faster in a direction parallel to the orientation of the long paper fibers. A typical 8.5"×11" paper sheet has long paper fibers oriented substantially parallel to the 11" direction, and moisture therefore penetrates preferentially into the 8.5" edges. This causes the nominally 8.5" edges to expand, so that the 8.5" edges become about 1% to 2% longer than the width of the paper measured across the center of the sheet (parallel to the 11" direction). It is usual practice to feed such paper sheets into a fuser nip with the 8.5" edges parallel to the feeding direction, i.e., perpendicular to the roller axes. Therefore, unless corrective measures are taken, it typically takes a longer time for the swollen 8.5" edges to pass through the fusing nip than it does for the middle of the sheet, which can result in severe paper wrinkling and large scale image defects. In order to provide a correction for this problem, it is known that elastomerically coated fusing station rollers can be manufactured with an axially varying profile obtained by gradually varying the thickness of the elastomeric coating, such that the outer diameter of a roller is greater near the ends of the roller than half way along the length of the roller. Inasmuch as elastomerically induced overdrive increases with increasing engagement, the larger engagements nearer the ends of the roller produce locally larger surface velocities of the paper through the nip, thereby tending to compensate for humidity induced paper swelling by having all portions of the paper spend substantially the same time passing through the nip. As is also well known, a pressure nip formed between two rollers, at least one of which has an elastomeric coating, does not usually have a uniform pressure distribution measured in the axial direction along the length of the rollers. Rather, owing to the fact that the compressive forces are applied at the ends of the rollers, e.g., to the roller axle, the rollers tend to bow outwards slightly, thereby producing a higher pressure near the ends of the rollers than half way along their length. This also tends to produce greater overdrive towards the ends of the rollers. However, the amount of extra overdrive from roller bending is not normally sufficient to compensate for humidity-induced paper swelling, and therefore a profiling of the thickness of the elastomeric coating in the axial direction, as described above, is often practiced.

As previously mentioned, PDMS cushion layers can include fillers including inorganic particulate materials, for example, metals, metal oxides, metal hydroxides, metal salts, and mixtures thereof. For example, Fitzgerald U.S. Pat. No. 5,292,606, the disclosure of which is incorporated herein by reference, describes fuser roller base cushion layers that contain fillers including particulate zinc oxide and zinc oxide-aluminum oxide mixtures. Similarly, Fitzgerald U.S. Pat. No. 5,336,539, the disclosure of which is incorporated herein by reference, describes a fuser roller cushion layer containing dispersed nickel oxide particles. Also, the fuser roller described in Fitzgerald et al. U.S. Pat. No. 5,480,724, the disclosure of which is incorporated herein by reference, includes a base cushion layer containing 20 to 40 volume percent of dispersed tin oxide particles.

Filler particles can also be included in a barrier layer. For example, in Chen et al., U.S. Pat. No. 5,464,698, the disclosure of which is incorporated herein by reference, is described a toner fuser member having a silicone rubber cushion layer and an overlying layer of a cured fluorocarbon polymer in which is dispersed a filler including a particulate mixture that includes tin oxide.

Chen et al., in U.S. patent application Ser. No. 08/879,896, disclose an improved fuser roller including three concentric layers each including a particulate filler, i.e., a base cushion layer including a condensation-cured PDMS, a barrier layer covering the base cushion and having a cured fluorocarbon polymer, and an outer surface layer including an addition-cured PDMS, the particulate fillers in each layer including one or more of aluminum oxide, iron oxide, calcium oxide, magnesium oxide, tin oxide, and zinc oxide. The barrier layer, which can include a Viton™ elastomer (sold by DuPont) or a Fluorel™ elastomer (sold by Minnesota Mining and Manufacturing), is a relatively low modulus material typically having a Young's modulus less than about 10 MPa, and it therefore has a negligible effect upon the mechanical characteristics of the roller, including overdrive.

Vrotacoe et al., in U.S. Pat. No. 5,553,541, disclose a printing blanket, for use in an offset printing press, which includes a seamless tubular elastic layer including compressible microspheres, surrounded by a seamless tubular layer made of a circumferentially inextensible material, and a seamless tubular printing layer over the inextensible layer. It is disclosed that provision of the inextensible layer reduces or eliminates pre-nip and post-nip bulging of the roller when printing an ink image on a receiver sheet, thereby improving image quality by reducing or eliminating ink smearing caused by slippage associated with the formation of bulges in the prior art.

To improve image quality, and also to reduce wear and aging and thereby prolong the life of a compliant roller in a fusing station, there remains a need for a compliant fusing roller or pressure roller for use in electrostatography having a reduced or negligible propensity to exhibit overdrive behavior when engaged in a fusing nip with a non-compliant roller, or with another compliant roller. There particularly remains a need for an internally-heated compliant toner fuser roller that has a negligible propensity to produce overdrive-induced image defects, either large-scale or small-scale, when used with a relatively non-compliant pressure roller. Moreover, there is also a need for such an overdrive-controlling fuser roller to be able to provide an axially varying differential overdrive, in order to compensate for a humidity induced nonuniform swelling of receivers. The fusing station rollers of the present invention, which include a thin, flexible stiffening layer, meet these needs.

SUMMARY OF THE INVENTION

The invention provides an improved fusing station of an electrostatographic machine using an internally heated fuser roller. The fusing station includes a conformable or compliant multilayer roller, which includes a high modulus stiffening layer located near or at the surface of the roller and a preferably substantially incompressible blanket layer. The multilayer roller can include an internally heated fuser roller, or a pressure roller. The stiffening layer provides improved image quality resulting from a dramatically reduced propensity for overdrive in a fusing nip. Because of the reduced overdrive, a roller of the invention wears much more slowly and has longer operational life than a prior art roller having no stiffening layer. Preferably, the stiffening layer of an internally heated fuser roller according to the invention includes a thin high-modulus material having good thermal conductance so as to provide the roller with a more uniform surface temperature, and hence an improved fusing uniformity. An improved fusing station of the invention can include an internally heated compliant fuser roller having a stiffening layer and a compliant pressure roller having a stiffening layer, or it can include an internally heated compliant fuser roller having a stiffening layer and a hard pressure roller. Also, an internally heated hard fuser roller can be used with a compliant pressure roller having a stiffening layer. A multilayer roller having a stiffening layer can be used in simplex and duplex fusing stations. In a duplex station, each of the rollers including the fusing nip is internally heated and can have a stiffening layer.

In accordance with the invention there is provided a product and process for forming an internally heated roller configuration for use in an electrostatographic machine the employs a fuser roller and a pressure roller. One of the rollers is a conformable roller including a rigid cylindrical core member centered on an axis of rotation, a compliant base cushion layer formed on the core member; a stiffening layer in intimate contact with and surrounding the base cushion layer; and an internal heating mechanism, while the other roller is a hard roller.

BRIEF DESCRIPTION OF THE DRAWINGS

In the detailed description of the preferred embodiments of the invention presented below, reference is made to the accompanying drawings, in some of which the relative relationships of the various components are illustrated, it being understood that orientation of the apparatus can be modified. For clarity of understanding of the drawings, relative proportions depicted or indicated of the various elements of which disclosed members are included can not be representative of the actual proportions, and some of the dimensions can be selectively exaggerated.

DETAILED DESCRIPTION OF THE PREFERRED EMBODIMENTS

Figure 1:
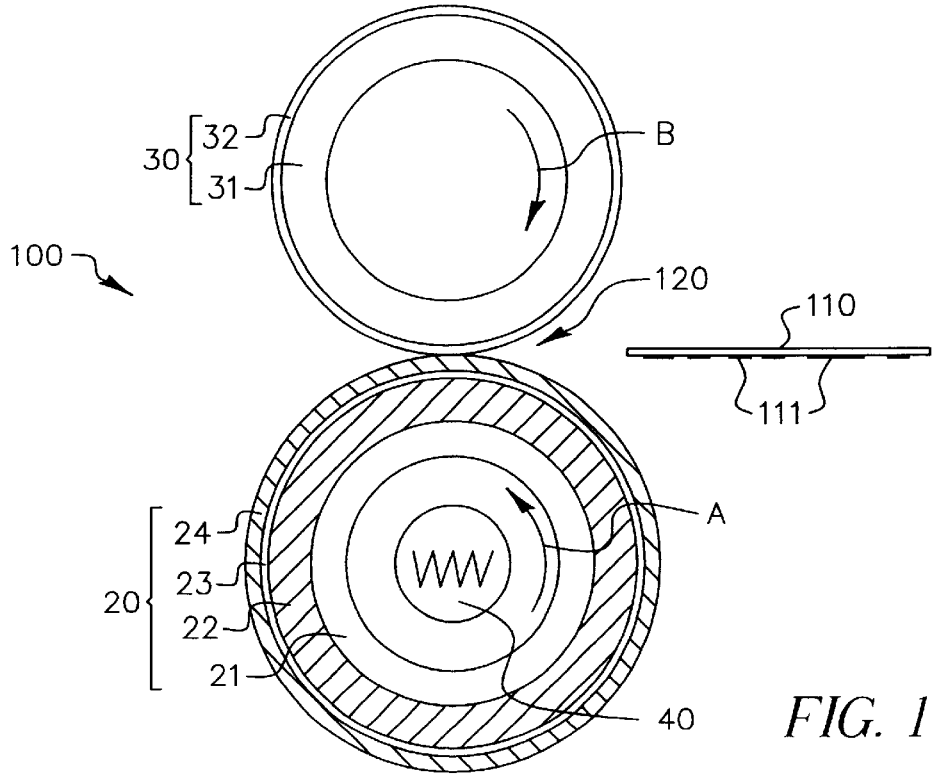
FIG. 1 depicts an end view of a simplex toner fusing station which includes a hard pressure roller engaged in a fusing nip with an internally-heated compliant fuser roller which includes a seamless stiffening layer.

Because apparatus of the type described herein are well known, the present description will be directed in particular to subject matter forming part of, or cooperating more directly with, the present invention.

The invention relates to electrostatographic reproduction utilizing a fusing station to thermally fuse an unfused toner image to a receiver, e.g., paper. The fusing station preferably includes two rollers which are engaged to form a fusing nip in which an internally heated fuser roller comes into direct contact with the unfused toner image as the receiver is frictionally moved through the nip. The internally heated roller is heated by a heat source located beneath an outer surface of the roller which is the rolling surface. The receiver can consist of a cut sheet or it can be a continuous web. The unfused toner image can include a single-color toner or it can include a composite image of two or more single-color toners, e.g., a full color composite image made for example from black, cyan, magenta, and yellow toners. The unfused toner image is previously transferred, e.g., electrostatically, to the receiver from a toner image bearing member such as a primary image-forming member or an intermediate transfer member. The electrostatographic reproduction can utilize a photoconductive electrophotographic primary image-forming member or a non-photoconductive electrographic primary image-forming member. Particulate dry or liquid toners can be used.

A simplex fusing station of the invention can include several embodiments. In the most preferred embodiment, applicants claim a novel compliant internally heated fuser roller which includes a stiffening layer, engaged in a fusing nip with a hard pressure roller. In this embodiment, a distorted shape of the compliant roller in the nip helps to release the receiver from the fuser roller and tends to guide it more towards the hard pressure roller as the receiver passes out of the nip. In two other preferred embodiments, a hard internally heated fuser roller is engaged in a fusing nip with a compliant pressure roller which includes a stiffening layer, or a compliant internally heated fuser roller which includes a stiffening layer is engaged in a fusing nip with a compliant pressure roller which also includes a stiffening layer. A simplex fusing station of the invention can be used to fuse an unfused toner image to one side of a receiver which already has a previously fused toner image on the reverse side.

A preferred embodiment of a duplex fusing station of the invention includes a compliant internally heated first fuser roller which includes a stiffening layer, engaged in a fusing nip with a compliant internally heated second fuser roller which includes a stiffening layer. The duplex fusing station simultaneously fuses two unfused toner images, one on the front and one on the back of the receiver.

In other embodiments, the stiffening layer of a roller of a fusing station is provided with an axial variation of stiffness, i.e., having a variation parallel to the roller axis, the stiffness being measured parallel to a tangential direction of rotation of the roller. It is preferred that the stiffness of the stiffening layer is greatest half way along the length of the roller, and least near each end of the roller.

In additional embodiments, a roller of a fusing station is provided with a stiffening layer which is located at different depths along the length of the roller. It is preferred for a fusing roller that the stiffening layer is located deepest near each end of the roller, and shallowest substantially half way along the length of the roller.

In yet other embodiments, a roller of a fusing station including a stiffening layer is provided with a core member which has a variable bending stiffness that varies along a direction parallel to the roller axis. It is preferred that said variable bending stiffness of a fuser roller has a minimum value located substantially at the midpoint along the length of the roller, and has maximum values near the ends of the roller.

In still other embodiments, a roller of a fusing station including a stiffening layer is provided with an outside diameter which varies along a direction parallel to the roller axis. Preferably, a maximum of said outside diameter of a fuser roller is located near each end of the roller and a minimum is located substantially half way along the length of the roller.

In yet still other embodiments, a roller of a fusing station including a stiffening layer is provided with a core member having an outer diameter that varies axially systematically, such that the outer diameter of the core is a minimum substantially half way along the length of the core member and becomes gradually larger towards each end of the core member.

In further embodiments, an internally heated fuser roller includes a stiffening layer which is shorter than the length of a receiver measured parallel to the fuser roller axis when the fuser roller is being utilized for fusing a toner image to a receiver.

In all embodiments, inventive rollers are preferably cylindrically symmetrical, i.e., a cross-section of the roller taken at right angles to the roller axis anywhere along the length of the roller has radial symmetry around the roller axis.

Although not explicitly disclosed in the preferred embodiments, it will be understood that an optional supplementary source of heat for fusing, either external or internal, can be provided to any roller included in a fusing station of the invention.

Referring now to the accompanying drawings, FIG. 1 shows the most preferred embodiment of an inventive simplex fuser station, designated by the numeral 100. A rotating fuser roller 20 moving in the direction indicated by an arrow includes a cylindrical core 21, a relatively thick compliant layer 22 formed on the core, a seamless stiffening layer 23 in intimate contact with and surrounding the compliant layer 22, and a compliant release layer or outer compliant layer 24 coated on the stiffening layer. (Henceforth the terms "release layer" and "outer compliant layer" are used interchangeably and mean the same thing). A counter-rotating hard pressure roller 30 moving in the direction of an indicated arrow forms a fusing nip 120 with compliant fuser roller 20. A receiver sheet 110 carrying an unfused toner image 111 facing the fuser roller 20 is shown approaching nip 120. The receiver sheet is fed into the nip by employing well known mechanical means (not shown) such as a set of rollers or other means such as a moving web. The fusing station preferably has one driving roller, either the fuser roller or the pressure roller, the other roller being driven and rotated frictionally by contact.

The pressure roller 30 includes a core member 31 and an optional surface layer 32 coated on the core. The core can be made of any suitable rigid material, e.g., aluminum, preferably including a cylindrical tube. Optional surface layer 32 is preferred to be less than about 1.25 mm thick and preferably includes a thermally stable preferably low-surface-energy compliant or conformable material, for example a silicone rubber, e.g., a PDMS, or a fluoroelastomer such as a Viton™ (from DuPont) or a Fluorel™ (from Minnesota Mining and Manufacturing). Alternatively, layer 32 can include a relatively hard poly(tetrafluoroethylene) or other suitable polymeric coating. A bare core having no layer 32 can include, for example, anodized aluminum or copper.

The heat source can include, for example, an electrically resistive element located inside a preferably thermally conductive core member 21, the resistive element being ohmically heated by passing electrical current through it. For example, an axially centered tubular incandescent heating lamp, such as lamp 40, or an ohmically heated resistive filament or other suitable interior source of heat within the core member, can be used. Preferably, the heat source is controlled by a feedback circuit. For example, a thermocouple can be used to monitor and thereby control the surface temperature of fuser roller 20 by employing a programmable voltage power supply (not shown) to regulate the temperature of lamp 40.

In alternative embodiments of internal heating, the heat source can be located within the body of the fuser roller outside the core member, in which case the core member need not be thermally conductive. For example, the stiffening layer can be electrically resistive and the internal source of heat can include ohmic heating of the stiffening layer by passing electrical current through it, or the stiffening layer can include an electrically resistive printed circuit on its surface and the internal source of heat can include ohmic heating of the printed circuit. The internal source of heat can also include ohmic heating of an array of one or more electrically resistive wires located within or in close proximity to the stiffening layer. In these alternative embodiments, feedback control of the surface temperature of the fuser roller is easier than when the heat source is inside the core (as shown in FIG. 1) owing to the fact that the source of heat is located much closer to the rolling surface of the roller, i.e., the heat capacitance of the material between the heat source and the rolling surface of the roller is considerably less. As a result, the thermal response time is advantageously much reduced, making possible more rapid adjustments, as can be needed, of the surface temperature of the roller. In some applications it can be desirable to provide both a heat source inside the core as well as a heat source in the vicinity of, or in, the stiffening layer.

At least one of any layers located outward of the internal heat source is thermally conductive, whether the heat source is located within the core member or outside the core member. A thermally conductive layer as described herein is a layer having a thermal conductivity greater than or equal to about 0.08 BTU/hr/ft/° F.

The fuser roller 20 includes a rigid core member preferably in the form of a cylindrical tube 21 made from any suitable material, e.g., aluminum The core member can have internal reinforcing members, e.g., struts, or other internal strengthening structures (not shown). Coated on the core member 21 is a relatively thick compliant base cushion layer (BCL) designated 22. To promote adhesion between the core and the BCL, a thin primer layer (not shown in FIG. 1) can be used, such as for example made from air-dried GE 4044 priming agent (sold by General Electric). In intimate contact with and surrounding the BCL is a thin stiffening layer 23. Intimate contact is defined as an interface substantially free of bubbles or voids, and can be adhesive or non-adhesive. Coated on the stiffening layer (SL) is a relatively thin release layer or outer compliant layer (OCL) designated 24. The BCL and OCL can be made of different compliant materials.

The base cushion layer 22 can include any suitable thermally stable elastomeric material, such as a fluoroelastomer, e.g., a Viton™ (from DuPont) or a Fluorel™ (from Minnesota Mining and Manufacturing) further including a suitable particulate filler to provide a useful thermal conductivity. Alternatively, the BCL can include a rubber, such as an EPDM rubber made from ethylene propylene diene monomers further including a particulate filler, preferably of iron oxide. The BCL can also include an addition cured silicone rubber which includes a chromium (III) oxide filler. However, it is preferred that the BCL includes a condensation-cured poly(dimethylsiloxane) elastomer further including a filler which can be aluminum oxide, iron oxide, calcium oxide, magnesium oxide, nickel oxide, tin oxide, zinc oxide, or mixtures thereof. This filler preferably includes particles having a mean diameter between 0.1 micrometer and 100 micrometers and 5 to 50 volume percent of the base cushion layer, and more preferably, a mean diameter between 0.5 micrometer and 40 micrometers and 10 to 35 volume percent of the base cushion layer. In a preferred embodiment, the filler includes zinc oxide particles. The base cushion layer 22 preferably has a thickness between 0.25 mm and 7.5 mm, and more preferably, between 2.5 mm and 5 mm. The BCL preferably has a thermal conductivity in a range between 0.08 to 0.7 BTU/hr/ft/° F., and more preferably, in a range of 0.2 BTU/hr/ft/° F.–0.5 BTU/hr/ft/° F. The BCL also has a Poisson's ratio preferably between 0.4 and 0.5, and more preferably, between 0.45 and 0.5. In addition, the base cushion layer preferably has a Young's modulus in a range of 0.05 MPa–10 MPa, and more preferably, 0.1 MPa–1 MPa.

The stiffening layer 23 can be included of any suitable material, including metal, elastomer, plastic, woven material, fabric, cordage, mesh or reinforced material such as, for example, a reinforced silicone rubber belt. A cordage is defined as a continuous strand of any suitable material or a portion thereof wound around the roller, where the number of windings per unit length along the roller can be systematically varied. Alternatively, a cordage can include individual rings or loops of any suitable material, the loops being concentric with the roller axis, and the number of loops per unit length measured axially along the roller can be systematically varied. A material which is impervious to penetration by fuser oil is preferred, inasmuch it is known that elevated temperature contact with fuser oil can deleteriously affect a base cushion layer and cause it to have a reduced operational life. It is preferred that the SL has good thermal conductance, which helps to reduce variations in temperature near the surface of the roller and thereby improves fusing uniformity and image quality. The stiffening layer 23 can be adhesively bonded to the BCL 22. The SL preferably includes a suitably flexible high-modulus metal or plated metal, including e.g., copper, gold, steel, and more preferably, nickel. Not as preferably, the SL can include a sol-gel or a ceramer or an elastomer such as for example a polyurethane, a polyirmide, a polyamide or a fluoropolymer, the SL having a yield strength which is not exceeded during operation of the roller. The stiffening layer preferably has the form of a seamless endless belt. Less preferably, the stiffening layer can include a sheet wrapped around the base cushion layer and smoothly joined by a seam to create an endless belt, and the seam can include an adhesive or a weld. It is preferable that the stiffening layer has a thickness in a range of 10 micrometers–500 micrometers, and more preferable, 75 micrometers–250 micrometers. The Young's modulus of the SL is preferably between 0.25 GPa and 500 GPa, and more preferably, 10 GPa–300 GPa. The thickness of the stiffening layer is preferably between 10 micrometers and 500 micrometers, and more preferably, 75 micrometers–250 micrometers.

The outer compliant layer or compliant release layer 24 preferably has a highly smooth outermost surface. The OCL is preferred to be highly resistant to abrasion, and can include any suitable elastomeric material preferably having a low surface energy, such as for example a silicone rubber, or a fluoroelastomer. The OCL can include for example a PDMS, preferably an addition-cured poly(dimethylsiloxane) elastomer and silica and titania fillers. The OCL has a roughness value, Ra, no greater than about 10 microinches, as determined by measurements on a 15-inch long roller using a Federal Surfanalyzer 4000 Profilometer provided with a transverse chisel stylus moving at a speed of 2.5 mm/sec. A release layer 24 providing suitable smoothness, of which the composition and coating method are disclosed by Chen et al. in U.S. application Ser. No. 08/879,896, can include Silastic™ E RTV silicone rubber available from Dow Coming Corporation. The compliant release layer has a thickness preferably less than 500 micrometers, and more preferably in a range between 25 micrometers and 250 micrometers. The OCL preferably has a thermal conductivity in a range of 0.2–0.5 BTU/hr/ft/° F., and a Young's modulus between 0.05 MPa and 10 MPa, more preferably 0.1 MPa–1 MPa. The Poisson's ratio of the OCL is preferably between 0.4 and 0.5, and more preferably, between 0.45 and 0.5. The compliant release layer further includes a particulate filler which can be aluminum oxide, iron oxide, calcium oxide, magnesium oxide, nickel oxide, tin oxide, zinc oxide, copper oxide, titanium oxide, silicon oxide, graphite, and mixtures thereof, and preferably zinc oxide. The particulate filler preferably includes 5 to 50 volume percent of said release layer, and more preferably, 10 to 35 volume percent. Preferably, the filler helps to provide good thermal conductivity in the OCL, which reduces variations in temperature near the surface of the roller and thereby improves fusing uniformity and image quality.

If the selected stiffening layer 23 is not impervious to fuser oil, an optional thin barrier layer (not shown in FIG. 1) can be coated on the stiffening layer underneath the OCL 24. The barrier layer preferably includes a fluoropolymer and 20 to 40 volume percent of a particulate filler. The fluoropolymer is preferably a random copolymer formed from mixtures of monomer units selected from vinylidene fluoride, tetrafluoroethylene, and hexafluoropropylene. The filler can be aluminum oxide, iron oxide, calcium oxide, magnesium oxide, nickel oxide, tin oxide, and mixtures thereof. Preferably the optional barrier layer has a thickness in a range of approximately 10 micrometers to 50 micrometers. The barrier layer can be thicker when coated on a stiffening layer including a semi-open structure such as a woven material or a fabric.

The preferred fuser roller 20 including a stiffening layer in the form of an endless seamless belt is preferably made in three steps. The first step is to provide the core member 21 uniformly coated with the base cushion layer 22. In the second step, the SL 23 in the shape of a seamless metal tube, preferably an electroformed belt preferably made of nickel available from Stork Screens America, Inc., of Charlotte, N.C., is mounted on a mandrill and coated with the release layer. The inner diameter of the as-purchased electroformed belt is a little smaller than the outside diameter of the BCL on the core, typically about 300 micrometers smaller. In the third step, the electroformed belt coated by the OCL is slid over the BCL on the core to create a completed roller 20. To accomplish the third step, the core plus base cushion layer can be cooled to a low temperature in order to contract it, so that the OCL-coated electroformed belt having a higher temperature can be slid into place. When the assembled roller is returned to room temperature, the stiffening layer is placed under tension so as to snugly and uniformly clasp the BCL. Alternatively, the third step can be accomplished by using a well-known compressed air assist technique to elastically stretch the OCL-coated electroformed tube slightly so that it can be slid into place. After the coated SL is satisfactorily placed in a suitable position on the base cushion layer, and the compressed air turned off, the stretched SL relaxes and grips the stiffening layer snugly. Although the SL in its final position after the third step is preferably in intimate non-adhesive contact with the BCL, an adhesive coating can be applied to the BCL surface in order to adhesively bond the SL to the BCL.

Figure 2:
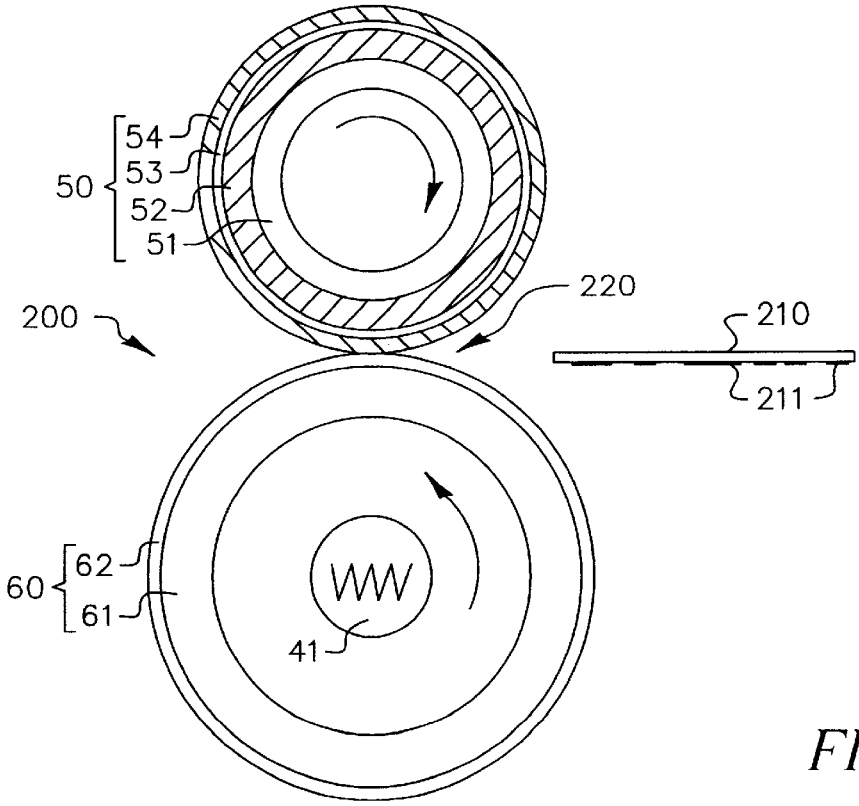
FIG. 2 depicts an end view of a simplex toner fusing station which includes an internally-heated hard fuser roller engaged in a fusing nip with a compliant pressure roller which includes a seamless stiffening layer.

A second preferred embodiment of an inventive simplex fusing station is shown as 200 in FIG. 2. It includes an internally heated hard fuser roller 60, and a compliant pressure roller 50 including a stiffening layer. A receiver sheet 210 carrying an unfused toner image 211 is shown approaching a fusing nip 220 formed by engaged rollers 50 and 60.

The fuser roller 60 includes a rigid cylindrical core member 61, preferably made from aluminum, and a low-surface-energy compliant outer layer 62 coated on the core. Layer 62 is preferred to be than 1.25 mm thick and can include a poly(tetrafluoroethylene) or another hard preferably low-surface-energy polymer, or more preferably includes a compliant or conformable preferably low-surface-energy layer including a silicone rubber, e.g., a PDMS, or a fluoroelastomer such as a Viton™ (from DuPont) or a Fluorel™ (from Minnesota Mining and Manufacturing).

The heat source can include, for example, an electrically resistive element located inside a preferably thermally conductive core member 21, the resistive element being ohmically heated by passing electrical current through it. For example, an axially centered tubular incandescent heating lamp, such as lamp 40, or an ohmically heated resistive filament or other suitable interior source of heat within the core member, can be used. Preferably, the heat source is controlled by a feedback circuit. For example, a thermocouple can be used to monitor and thereby control the surface temperature of fuser roller 20 by employing a programmable voltage power supply (not shown) to regulate the temperature of lamp 40.

The compliant pressure roller 50 includes a rigid cylindrical core member 51, preferably made from aluminum, a compliant base cushion layer 52 coated on the core member, a stiffening layer 53 preferably in the form of a seamless endless belt in intimate contact with and surrounding layer 52, and an optional outer compliant layer 54. The base cushion layer 52 includes a suitable thermally stable elastomer, e.g., a fluoroelastomer, an EPDM rubber, a PDMS, or other suitable material preferably having thickness between 0.25 mm and 25 mm. The BCL preferably has a Young's modulus in a range of 0.05 MPa to 10 MPa and can further include a particulate filler or a foam. Base cushion layer 52 has a Poisson's ratio preferably between 0.2 and 0.5 and more preferably between 0.45 and 0.5. The BCL and OCL can be the same or different materials.

The stiffening layer 53 includes a thin, flexible, preferably high-modulus material having characteristics similar to those disclosed above for layer 23 of FIG. 1. Preferably, the stiffening layer is a seamless belt and is made of nickel.

The optional outer compliant layer 54 includes an elastomer, such as for example a PDMS or a fluoropolymer, having a thickness preferably less than 500 micrometers. Layer 54 preferably has a Young's modulus in a range of 0.05 MPa–10 MPa, and a Poisson's ratio preferably between 0.2 and 0.5 and more preferably between 0.45 and 0.5.

The preferred pressure roller 50 including a stiffening layer in the form of an endless seamless belt is preferably made in three steps. The first step is to provide the core member 51 uniformly coated with the base cushion layer 52. In the second step, the SL 53 in the shape of a seamless metal tube, preferably an electroformed belt preferably made of nickel available from Stork Screens America, Inc., of Charlotte, N.C., is mounted on a mandrill and coated with the release layer. The inner diameter of the as-purchased electroformed belt is a little smaller than the outside diameter of the BCL on the core, typically about 300 micrometers smaller. In the third step, the electroformed belt coated by the OCL is slid over the BCL on the core to create a completed roller 50. To accomplish the third step, the core plus base cushion layer can be cooled to a low temperature in order to contract it, so that the OCL-coated electroformed belt having a higher temperature can be slid into place. When the assembled roller is returned to room temperature, the stiffening layer is placed under tension so as to snugly and uniformly clasp the BCL. Alternatively, the third step can be accomplished by using a well-known compressed air assist technique to elastically stretch the OCL-coated electroformed tube slightly so that it can be slid into place. In order to aid sliding, a lubricating aid can be applied to either the BCL outer surface or the inner surface of the SL belt. Lubricating aids include materials which can produce a low-surface-energy sliding interface, such as for example sub-micron particles of silica and the like, zinc stearate, or other suitable materials. After the coated SL is satisfactorily placed in a suitable position on the base cushion layer, and the compressed air turned off, the stretched SL relaxes and grips the stiffening layer snugly. Although the SL in its final position after the third step is preferably in intimate non-adhesive contact with the BCL, an adhesive coating can be applied to the BCL surface in order to adhesively bond the SL to the BCL.

Figure 3:
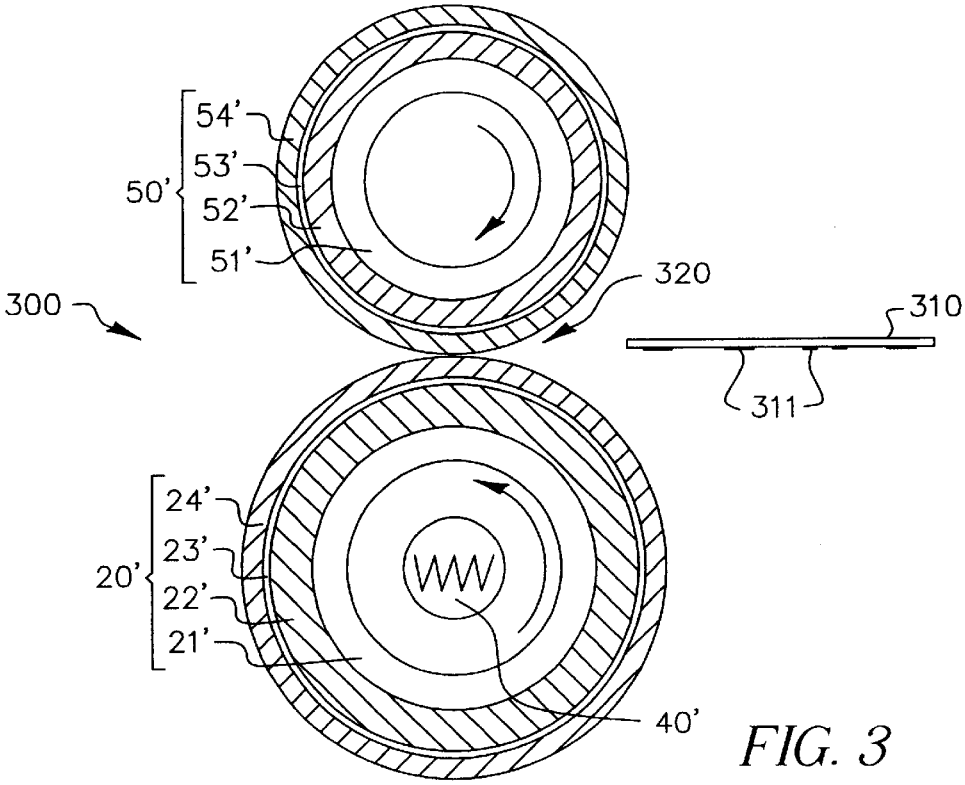
FIG. 3 depicts an end view of a simplex toner fusing station which includes an internally-heated compliant fuser roller which includes a seamless stiffening layer, engaged in a fusing nip with a compliant pressure roller which includes a seamless stiffening layer.

A third preferred embodiment of an inventive simplex fusing station is shown as 300 in FIG. 3, in which primed (') entities correspond to similar entities labeled by unprimed numerals in FIGS. 1 and 2. The material and physical characteristics of the primed entities are qualitatively and quantitatively the same as disclosed above for the unprimed entities, whereupon fusing station 300 includes an internally heated compliant fuser roller 20' including a stiffening layer preferably in the form of a seamless belt, and a compliant pressure roller 50' also including a stiffening layer preferably in the form of a seamless belt. A receiver sheet 310 carrying an unfused toner image 311 is shown approaching a fusing nip 320 formed by engaged rollers 20' and 50'. Fuser roller 20' includes a rigid cylindrical core 21', a base cushion layer 22' formed on the core, a stiffening layer 23' in intimate contact with and surrounding the BCL, and a release layer 24' coated on the SL. Fuser roller 20' having a preferably thermally conductive core 21' can be heated by an internal source of heat, such as provided for example by lamp 40', or alternatively the source of heat can include ohmic heating produced by passing electrical current through an element in the body of the roller outside the core, e.g., by passing electrical current through a resistive stiffening layer 23', or passing an electrical current through an electrically resistive printed circuit the surface of the stiffening layer, or through an array of one or more electrically resistive wires located within or in close proximity to the stiffening layer. Pressure roller 50' includes a rigid cylindrical core 21', a base cushion layer 22' formed on the core, a stiffening layer 23' in intimate contact with and surrounding the BCL, and an outer compliant layer 24' coated on the SL. The BCL and OCL can be made of different materials.

Figure 4:
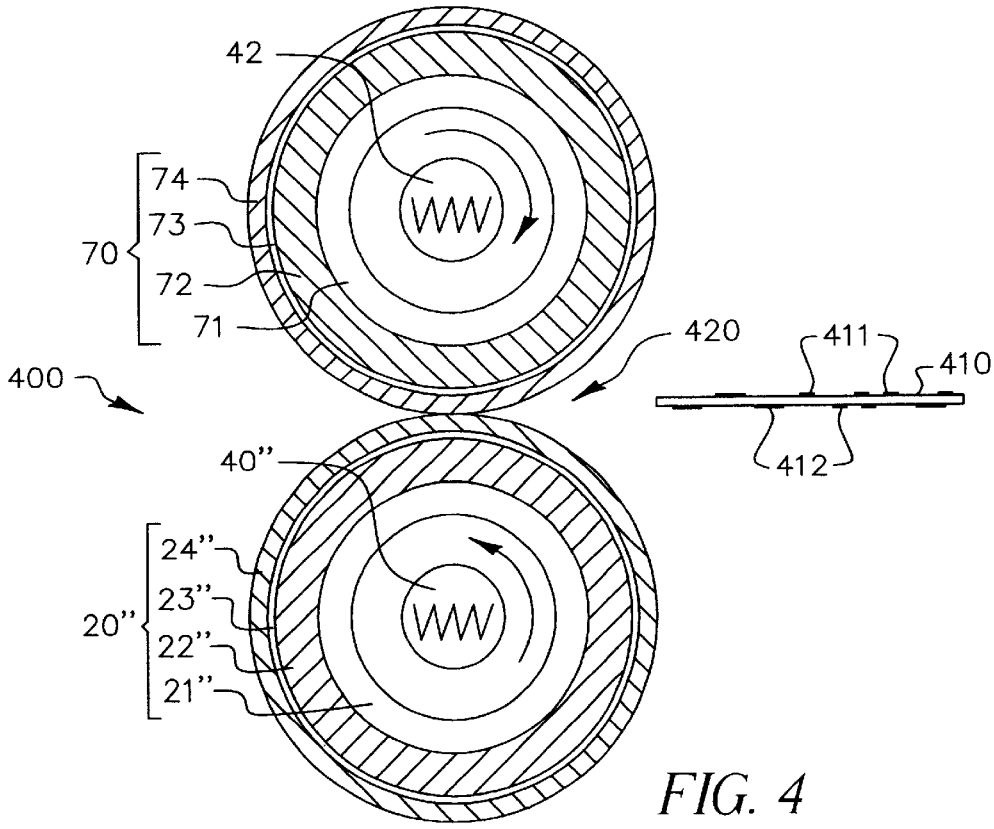
FIG. 4 depicts an end view of a duplex toner fusing station which includes an internally-heated compliant first fuser roller which includes a seamless stiffening layer, engaged in a fusing nip with an internally-heated compliant second fuser roller which includes a seamless stiffening layer.

A preferred embodiment of an inventive duplex fusing station is shown as 400 in FIG. 4. A first rotating fuser roller indicated as 20" includes a rigid cylindrical core 21", a base cushion layer 22" formed on the core, a stiffening layer 23" preferably in the form of a seamless belt in intimate contact with and surrounding the BCL, and a release layer 24" coated on the SL. The doubly-primed entities correspond to similar entities labeled by unprimed numerals in FIG. 1, and the material and physical characteristics of the doubly-primed entities are qualitatively and quantitatively the same as those disclosed above for the unprimed entities. A second counter-rotating fuser roller 70 forms a fusing nip 420 with the first fuser roller 20". The second fuser roller has the same structure as the first fuser roller, i.e., includes a rigid cylindrical core 71, a base cushion layer 72 formed on the core, a stiffening layer 73 preferably in the form of a seamless belt in intimate contact with and surrounding the BCL, and a release layer 74 coated on the SL. A receiver sheet 411 is shown approaching fusing nip 420. On each side of the receiver is an unfused toner image, labeled 411 and 412, respectively. The second fuser roller 70 is similar in other ways to the first fuser roller, inasmuch as it includes the same choices of materials and the same ranges of physical and material parameters as disclosed above for the fuser roller 20 of the first simplex embodiment. However, the two fuser rollers 20" and 70 can differ in specific dimensions, such as for example roller diameters, layer thicknesses, and so forth, and can also differ in specific choices of materials and material properties. In particular, the BCL and OCL in each roller can include the same or different compliant materials.

In the above disclosed preferred embodiments of inventive simplex and duplex fusing stations, the use of stiffening layers in compliant fuser and compliant pressure rollers reduces the propensity to overdrive, thereby markedly reducing wear as compared to prior rollers, especially of fuser rollers in contact with relatively hard and abrasive receivers such as paper. Image smear during fusing is also reduced and image quality thereby increased.

In order to help delineate the ranges of preferred parameters of the rollers claimed below by applicants, such as layer thicknesses, moduli, Poisson's ratios, and so forth, a computer was used to solve a finite element model of a simulated fusing nip in which a compliant roller including a stiffening layer is engaged with a hard roller. The calculations show, for example, that a minimum useful value of Young's modulus of a stiffening layer is very probably lower than 80,000 MPa. Therefore, in addition to a preferred metallic stiffening layer, a high-modulus non-metallic material can be useful.

EXAMPLE 1

Rate of Wear of a Compliant Fuser Roller

In order to anticipate the effect of a stiffening layer on reducing wear rate, a preliminary experiment was carried out to study whether the wear rate of a fuser roller having a compliant base cushion layer but no stiffening layer is dependent upon the thickness of the compliant base cushion layer. Two companion life tests were carried out in a full-process experimental electrophotographic machine, using two different compliant fuser rollers operated in a fusing station employing a new pressure roller of the same manufacture and same composition for each test. In the first test, the fuser roller was made from a 6.0" diameter aluminum core coated with a 0.20" layer of a red rubber (EC 4952 from Emerson Cummings), with the red rubber layer further coated by a 0.001" layer of a silicone rubber including an interpenetrating polymer network (IPN) as described by J. Chen et al., U.S. Pat. No. 5,582,917. In the second test, the fuser roller was the same except the red rubber layer was half as thick, i.e., 0.10". For each test, the pressure roller was made from a 3.5" diameter aluminum core coated with a 0.20" base cushion layer of IPN covered by a 0.001" layer of a fluoroelastomer (S5100 from Emerson Cummings). In both tests, the fuser roller surface temperature was controlled at 320° F., the engagement force between fuser and pressure rollers was the same in a constant force nip, and the same type of paper and toner image were used. After 100,000 prints had been made in each test, wear tracks caused by the paper receivers having depth 0.005"–0.008" were observed on the fuser roller having the thicker 0.20" red rubber blanket, but no measurable wear was observed on the fuser roller having the thinner 0.10" red rubber. It was concluded that the larger amounts of overdrive and flexure associated with the thicker red rubber layer were responsible for the much higher wear rate, as compared to the thinner layer which allowed the hard substrate core to have more influence. This Example therefore supports implementation of a stiffening layer in rollers requiring thick compliant layers which, as is well known, are typically needed to provide wide nip footprints desirable for superior fusing.

In certain embodiments described below, it is advantageous to provide a stiffening layer having a stiffness that varies along the length of a roller, in particular for an inventive fusing roller. It can also be advantageous to provide a variably stiff stiffening layer for a compliant pressure roller used in a fusing station of the invention. A variably stiff stiffening layer of a fuser roller can improve paper transport through a fusing station, particularly when paper receiver sheets are not perfectly rectangular as a result of humidity-induced swelling. A typical 8.5"×11" paper sheet has long paper fibers oriented substantially parallel to the 11" direction, and moisture penetrates preferentially into the 8.5" edges typically causing the nominally 8.5" edges to expand by about 1% to 2% compared to the nominal 8.5" width. It is usual practice to feed such paper sheets into a fuser nip with the 8.5" edges oriented parallel to the paper feeding direction, i.e., perpendicular to the roller axes. As a result, it typically takes a longer time for the swollen 8.5" edges to pass through the fusing nip than it does for the middle of the sheet. This can result in severe paper wrinkling and large scale image defects. To correct this problem, it is preferred that all portions of the paper spend substantially the same time passing through the nip. A means to accomplish this is to provide a greater amount of overdrive near the swollen 8.5" edges of the paper than at the center. As is also well known, a pressure nip formed between two rollers, at least one of which has an elastomeric coating, does not usually have a uniform pressure distribution measured in the axial direction along the length of the rollers. Rather, owing to the fact that the compressive forces are applied at the ends of the rollers, e.g., to the roller axle, the rollers tend to bow outwards slightly, thereby producing a higher pressure near the ends of the rollers than half way along their length. This also tends to produce greater overdrive towards the ends of the rollers. However, the amount of extra overdrive from roller bending is not normally sufficient to compensate for humidity-induced paper swelling, and embodiments including a variably stiff stiffening layer can be used.

In embodiments described below, a variably stiff stiffening layer is provided to produce a predetermined variation of overdrive along the length of a roller, e.g., to compensate for humidity-induced paper swelling. The variably stiff stiffening layer can be included in a fuser roller, e.g., rollers 20, 20', 20" or 70, or, in a pressure roller, e.g., rollers 50 or 50'. When a stiffening layer includes a cordage, a fabric, or a woven material, the spaces or interstices between cords or fibers can be filled by any suitable material, including a material of an adjacent layer of an inventive roller.

Figure 7:
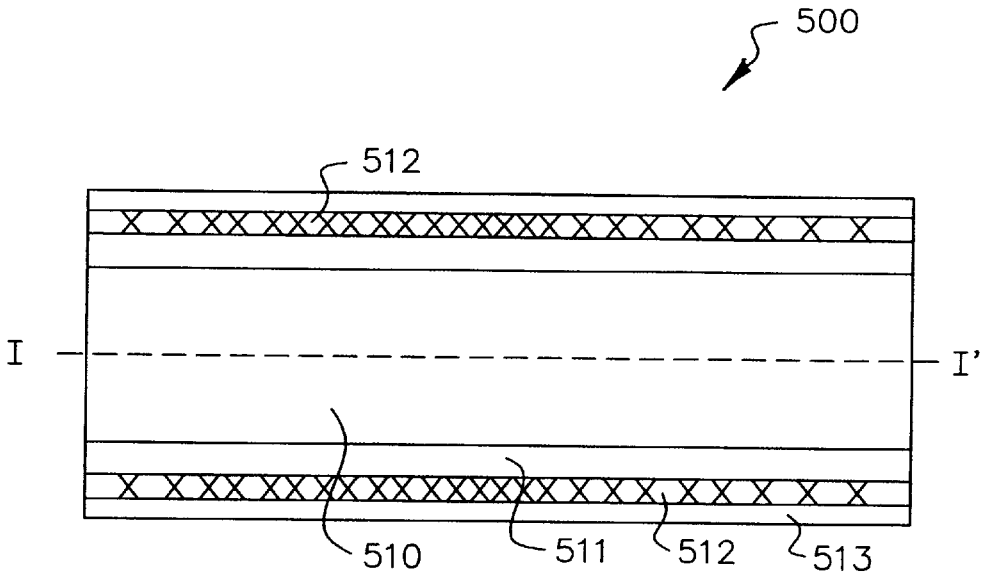
FIG. 7 shows a diagrammatic representation of a roller according to this invention, provided with a stiffening layer having a longitudinally variable Young's modulus.

In an embodiment utilizing a variably stiff stiffening layer, the stiffening layer of a roller of a fusing station according to the invention is provided with a Young's modulus that varies systematically parallel to the roller axis, the modulus being measured parallel to a tangential direction of rotation of the roller. It is preferred that the modulus of the stiffening layer of an inventive roller be greatest substantially midway along the length of the roller, and least near each end of the roller. As a result, when the roller is engaged in the fusing nip, there will be an increased amount of overdrive provided by the reduced stiffness of the stiffening layer near the edges of a paper sheet, as compared to the center of the paper, thereby providing a mechanism to ensure that all portions of the paper sheet spend substantially the same time passing through the nip. In this embodiment, the stiffening layer can include a continuous, thin, seamless metal tube in which the Young's modulus can be controlled, for example, by providing the metal as an alloy having a variable composition parallel to the roller axis. Alternatively, the stiffening layer can include a cordage in which the Young's modulus is changed systematically as a function of position along the roller, or the stiffening layer can include any other suitable material for which the Young's modulus can be systematically controlled and varied. FIG. 7 shows a longitudinal cross section of a diagrammatic representation of an exemplary inventive cylindrically symmetric roller, indicated as 500, provided with a stiffening layer 512 having a variable Young's modulus. Roller 500 includes a rigid core member 510, a compliant base cushion layer 511 formed on the core member, a stiffening layer 512 surrounding and in intimate contact with the base cushion layer 511 with stiffening layer 512 having a Young's modulus variable in a direction parallel to an axis of rotation indicated by I-I', and an outer compliant layer 513 on the stiffening layer. Stiffening layer 512 is shown with hatchings in which the density of hatching lines represents the magnitude of Young's modulus, with Young's modulus of stiffening layer 512 increasing from a minimum value at each end of the roller 500 towards a maximum value located at substantially the midpoint along the length of the roller. For clarity of understanding, the thickness of stiffening layer 512 has been greatly exaggerated. The longitudinal variation of Young's modulus of stiffening layer 512 can be smooth from an end of the roller 500 to substantially the midpoint, as indicated in FIG. 7, or it can have more or less abrupt changes. For example, individual longitudinal lengths or sections having discretely different Young's moduli can be used to make layer 512, where the individual lengths can be different materials. The individual longitudinal lengths need not be joined to form a continuous tube but can be separated by gaps, the gaps being preferably small enough so as to cause no noticeable effects at the exterior surface of compliant layer 513 that could result in a decreased fusing performance or quality. Moreover, the maximum value of Young's modulus can, if desired, extend for a suitable distance on either side of substantially the midpoint along the length of the roller 500.

Figure 8:
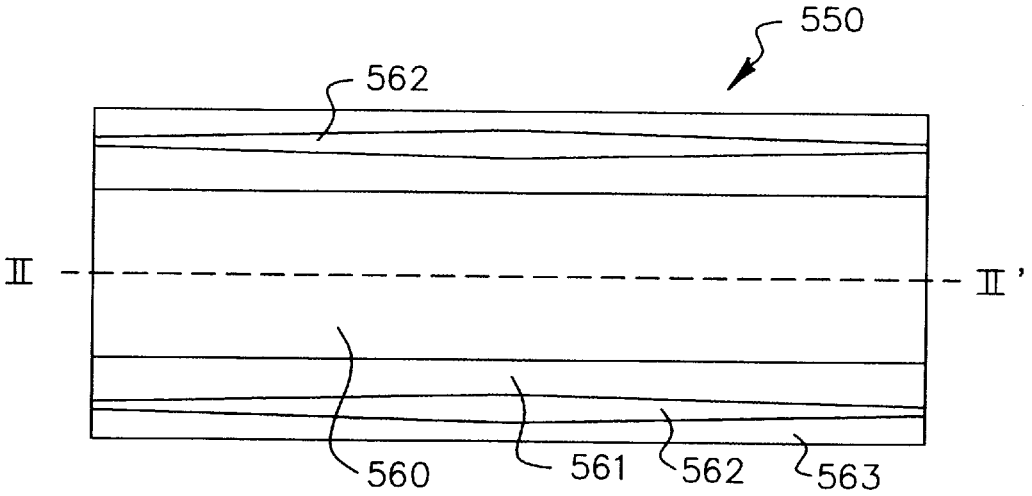
FIG. 8 shows a diagrammatic representation of a roller according to this invention, provided with a stiffening layer having a thickness that varies along the length of the roller.

In a further embodiment utilizing a variably stiff stiffening layer, the stiffening layer of a roller of a fusing station according to the invention is provided with a thickness that varies systematically parallel to the roller axis. It is preferred that the thickness of the stiffening layer of an inventive roller be greatest substantially midway along the length of the roller, and least near each end of the roller. As a result, when the roller is engaged in the fusing nip, there will be an increased amount of overdrive provided by the reduced thickness of the stiffening layer near the edges of a paper sheet, as compared to the center of the paper, thereby providing a mechanism to ensure that all portions of a paper sheet spend substantially the same time passing through the nip. In this embodiment, the stiffening layer preferably includes a continuous, seamless, thin metal tube in which the thickness can be systematically varied parallel to the roller axis. Alternatively, the stiffening layer can include a cordage in which the thickness of the cords is changed systematically as a function of position along the roller, or the stiffening layer can include any other suitable material for which the thickness can be systematically controlled and varied. FIG. 8 shows a longitudinal cross section of a diagrammatic representation of an exemplary inventive cylindrically symmetric roller, indicated as 550, provided with a stiffening layer 562 having a thickness that varies systematically parallel to the roller axis. Roller 550 includes a rigid core member 560, a compliant base cushion layer 561 formed on the core member, a stiffening layer 562 surrounding and in intimate contact with the base cushion layer 561 with the stiffening layer 562 having a thickness variable in a direction parallel to an axis of rotation indicated by II-II', and an outer compliant layer 563 on the stiffening layer. Stiffening layer 562 is shown with a thickness increasing from a minimum value at each end of the roller 550 towards a maximum value located at substantially the midpoint along the length of the roller. For clarity of understanding, the thickness of stiffening layer 562 has been greatly exaggerated along the entire length of the roller 550. The longitudinal variation of thickness of stiffening layer 562 can be smooth from an end of the roller 550 to substantially the midpoint, as indicated in FIG. 8, or it can have more or less abrupt changes. For example, individual longitudinal lengths or sections having discretely different thicknesses can be used to make layer 562. The individual longitudinal lengths need not be joined to form a continuous tube but can be separated by gaps, the gaps being preferably small enough so as to enough so as to cause no noticeable effects at the exterior surface of compliant layer 563 that could result in a decreased fusing performance or quality. Moreover, the maximum value of thickness of stiffening layer 562 can, if desired, extend for a suitable distance on either side of substantially the midpoint along the length of the roller 550. The stiffening layer 562 having a variable thickness can also include a mesh or a cordage (not illustrated) such that the diameters of the fibers, threads or wires of which the mesh or cordage is made are systematically varied so as to have a minimum diameter at or near each end of the roller 550 and a maximum diameter at substantially the midpoint along the length of roller 550.

Figure 9:
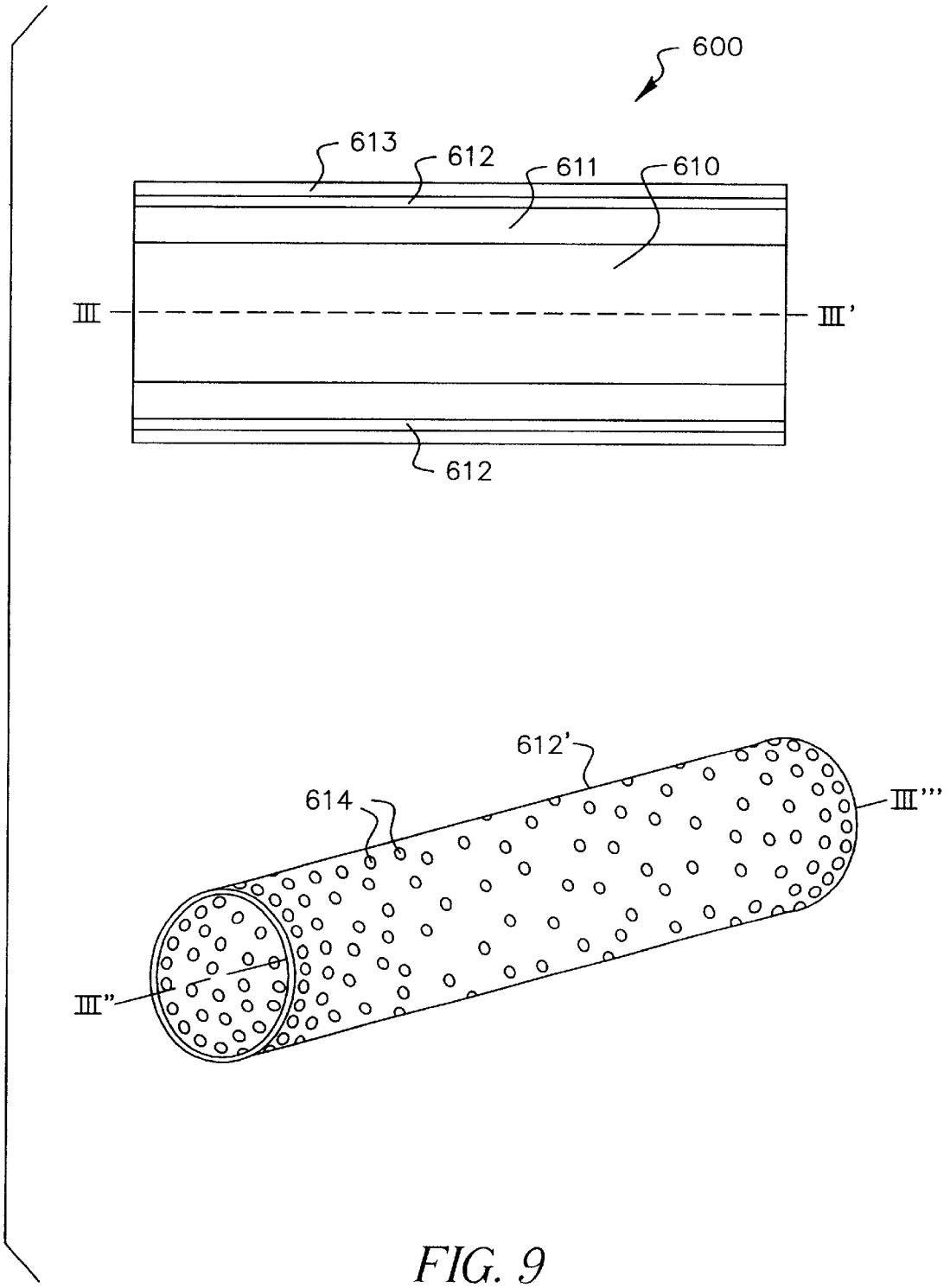
FIG. 9 shows a diagrammatic representation of a roller according to this invention, having a stiffening layer provided with a plethora of holes, with the combined area occupied by the holes varying along the length of the roller.

In another embodiment utilizing a variably stiff stiffening layer, the stiffening layer of a roller of a fusing station according to the invention is provided with a plethora of holes, preferably small holes, with the combined area occupied by the holes varying systematically along the length of the roller parallel to the roller axis. This can be accomplished by changing number of holes per unit area along the length of the roller, or by changing the area per hole along the length of the roller, or by a combination of variation of hole size and area per hole along the length of the roller. The holes can, therefore, have different sizes at different locations in the stiffening layer. It is preferred that the fractional area occupied by holes per unit length of an inventive roller be smallest substantially midway along the length of the roller, and greatest near each end of the roller. As a result, when the roller is engaged in the fusing nip, there will be an increased amount of overdrive provided by larger amount of strain in the stiffening layer near the edges of a paper sheet, as compared to the center of the paper, thereby providing a mechanism to ensure that all portions of a paper sheet spend substantially the same time passing through the nip. In this embodiment, the stiffening layer preferably includes a continuous, seamless, thin metal tube in which the holes can be provided, e.g., formed by punching, drilling, etching, or by using a laser. Alternatively, the stiffening layer can include any other suitable material in which the holes can be systematically be provided, such as a plastic or reinforced material. FIG. 9 shows a longitudinal cross section of a diagrammatic representation of an exemplary inventive cylindrically symmetric roller, indicated as 600, having a stiffening layer 612 provided with a plethora of holes, preferably small holes, with the combined area occupied by the holes varying systematically per unit length along the length of the roller parallel to the roller axis. Roller 600 includes a rigid core member 610, a compliant base cushion layer 611 formed on the core member, a stiffening layer 612 surrounding and in intimate contact with the base cushion layer 611 with stiffening layer 612 having an area occupied by holes variable in a direction parallel to the roller axis of rotation indicated by III-III', and an outer compliant layer 613 on the stiffening layer. For clarity of understanding, an embodiment of a stiffening layer 612'is depicted in the tubular representation shown in FIG. 9, in which a number per unit area of similar-sized holes 614 is shown varying, in a direction parallel to axis III"-III'", from a maximum value at or near each end of the stiffening layer 612' towards a minimum value located at substantially the midpoint along the length of the stiffening layer. For clarity, only a few approximately round holes 614 having exaggerated sizes are indicated in FIG. 9, the holes preferably having diameters which are smaller than the thickness of the stiffening layer. The holes can have any suitable shapes, including random shapes. Different sized holes can be used at different locations, and holes of different sizes can be used together in any local area of the stiffening layer 612. For an inventive fuser roller, it is preferred that the holes be small enough to produce no measurable effect on fusing uniformity. It is to be understood that, in other suitable embodiments of stiffening layer 612 (not illustrated), a variation in the total fractional area occupied by holes along the length of the stiffening layer can be accomplished by varying the area per individual hole, or by combining a variation of the area per individual hole with a variation in the number of holes per unit area of the stiffening layer. The longitudinal variation along the length of the stiffening layer of the area occupied by holes can be smooth, as indicated for layer 612', or it can have more or less abrupt changes. For example, individual longitudinal lengths or sections having discretely different fractional hole areas can be used to make layer 612. The individual longitudinal lengths need not be joined to form a continuous tube but can be separated by gaps, the gaps being preferably small enough so as to enough so as to cause no noticeable effects at the exterior surface of compliant layer 613 that could result in a decreased fusing performance or quality. Moreover, the minimum value of the area occupied by holes per unit length of the stiffening layer 612 can, if desired, extend for a suitable distance on either side of substantially the midpoint along the length of the roller 600. Additionally, the minimum value of the number of holes per unit area provided or formed in the stiffening layer can be zero, such that holes can be provided or formed only near each end of the stiffening layer. When outer compliant layer 613 is formed on the stiffening layer, the material of layer 613 can be made to penetrate and fill the holes. Alternatively, the holes in the stiffening layer can be filled by any suitable other material, preferably a compliant material, and this is preferably done before the outer compliant layer 613 is formed on the stiffening layer 612.

Figure 10:
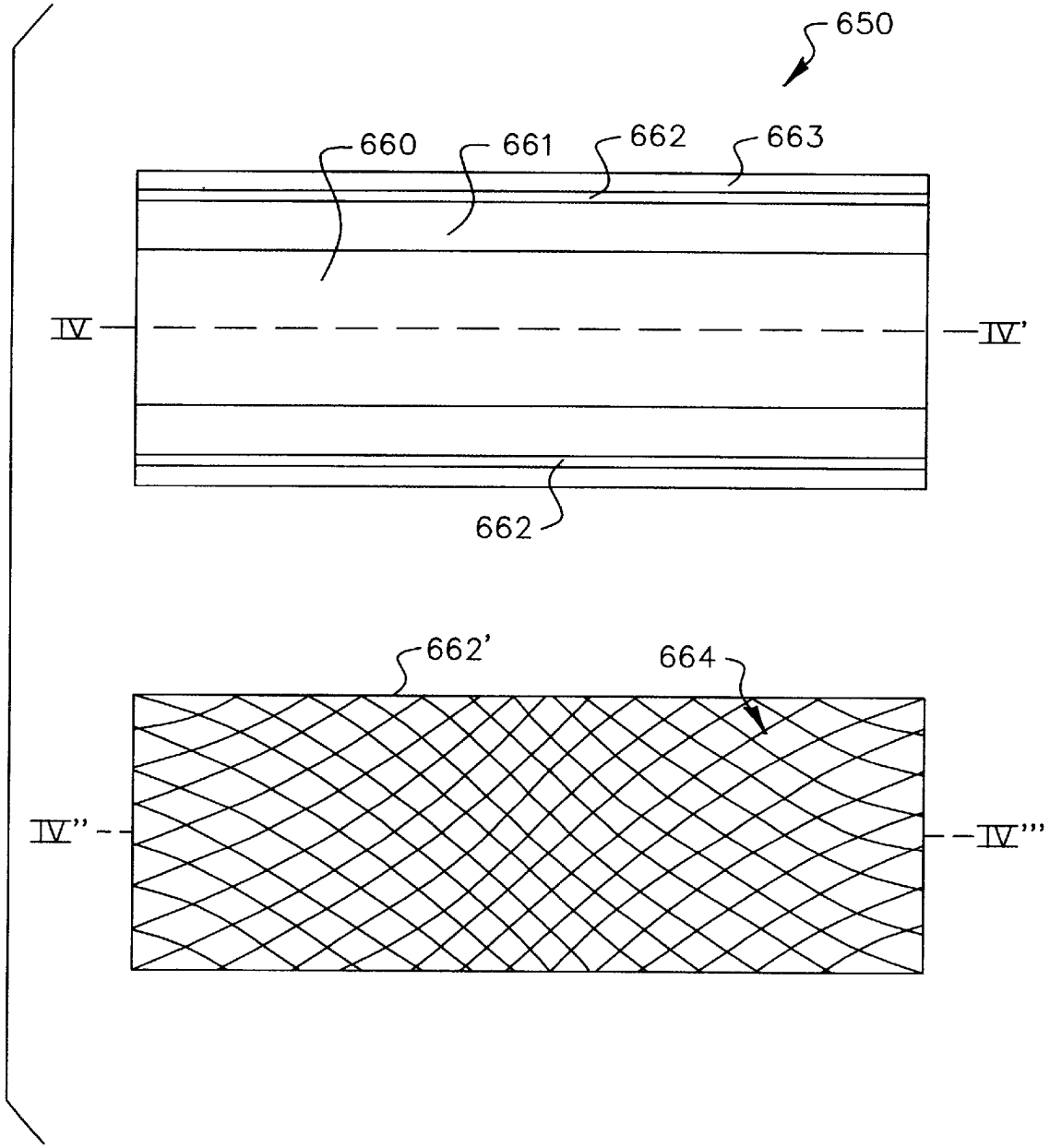
FIG. 10 shows a diagrammatic representation of a roller according to this invention, having a stiffening layer which includes a mesh or fabric in which the mesh density or fabric density is variable along the length of the roller.

In a further embodiment utilizing a variably stiff stiffening layer, the stiffening layer of a roller of a fusing station according to the invention includes a mesh or fabric in which the mesh density or fabric density is systematically variable along the length of the roller parallel to the roller axis. The density is proportional to the number of threads or wires per unit area, i.e., a high density in a given area of the mesh or fabric means a comparatively large number of threads or wires passing in any given direction, including sets of threads or wires that cross each other. It is preferred that the mesh or fabric density be lowest near the ends of an inventive roller, and highest substantially midway along the length of the roller. As a result, when the roller is engaged in the fusing nip, there will be an increased amount of overdrive provided by larger amount of strain in the stiffening layer near the edges of a paper sheet, as compared to the center of the paper, thereby providing a mechanism to ensure that all portions of the paper sheet spend substantially the same time passing through the nip. In this embodiment, the fabric or mesh can include natural or synthetic fibers, threads, metal wires or strips, or any other suitable preferably flexible material which can be woven into a fabric or mesh having a variable density. FIG. 10 shows a longitudinal cross section of a diagrammatic representation of an exemplary inventive cylindrically symmetric roller, indicated as 650, having a stiffening layer 662 which includes a mesh or fabric in which the mesh density or fabric density is systematically variable along the length of the roller parallel to the roller axis. Roller 650 includes a rigid core member 660, a compliant base cushion layer 661 formed on the core member, a stiffening layer 662 surrounding and in intimate contact with the base cushion layer 661 with stiffening layer 662 including a mesh having a density variable in a direction parallel to the roller axis of rotation indicated by IV-IV', and an outer compliant layer 663 on the stiffening layer. Stiffening layer 662 is separately indicated diagrammatically in side view for clarity of understanding. In an embodiment of a stiffening layer 662' depicted in a side view representation in FIG. 10, a woven fabric 664 is shown having a simple diagonal mesh, the mesh density varying, in a direction parallel to axis IV"-IV'", from a minimum value at or near each end of the stiffening layer 662' towards a maximum value located at substantially the midpoint along the length of the stiffening layer (crossings of fibers are not shown in detail). For clarity, a greatly enlarged mesh 664 is indicated in FIG. 10. For an inventive fuser roller, it is preferred that diameters of the fibers, threads or wires of which the mesh is made be small enough to produce no measurable effect on fusing uniformity. Similarly, it is preferred for an inventive fuser roller that the interstices between the fibers, threads or wires of which the mesh is made be small enough to produce no measurable effect on fusing uniformity. It is to be understood that, in other suitable embodiments of the stiffening layer 662 (not illustrated) the mesh can include any suitable weave, and it can have a simple form of a warp and a woof, or it can include a more complex weave, with the threads or wires passing in any suitable directions, including parallel and perpendicular to the axis IV-IV'. The mesh can be made of one or more different kinds of fibers, or fibers of one or more different diameters. For example, the simple mesh of the fabric 664 can be considered to be made of a warp and a woof, with the warp and woof being optionally made of different materials, or having fibers or threads of different diameters. The longitudinal variation of the mesh density along the length of the stiffening layer can be smooth, as depicted for layer 662', or it can have more or less abrupt changes. For example, individual longitudinal lengths or sections having discretely different mesh densities can be used to make layer 662. The individual longitudinal lengths need not be joined to form a continuous tube but can be separated by gaps, the gaps being preferably small enough so as to cause no noticeable effects at the exterior surface of compliant layer 663 that could result in a decreased fusing performance or quality. Moreover, the maximum value of the mesh density of the stiffening layer 662 can, if desired, extend for a suitable distance on either side of substantially the midpoint along the length of the roller 650. When outer compliant layer 663 is formed on the stiffening layer, the material of layer 663 can be made to penetrate and fill the interstices of the mesh. Alternatively, the interstices of the mesh included in the stiffening layer can be filled by any suitable other material, preferably a compliant material, and this is preferably done before the outer compliant layer 663 is formed on the stiffening layer 662.

Figure 11:
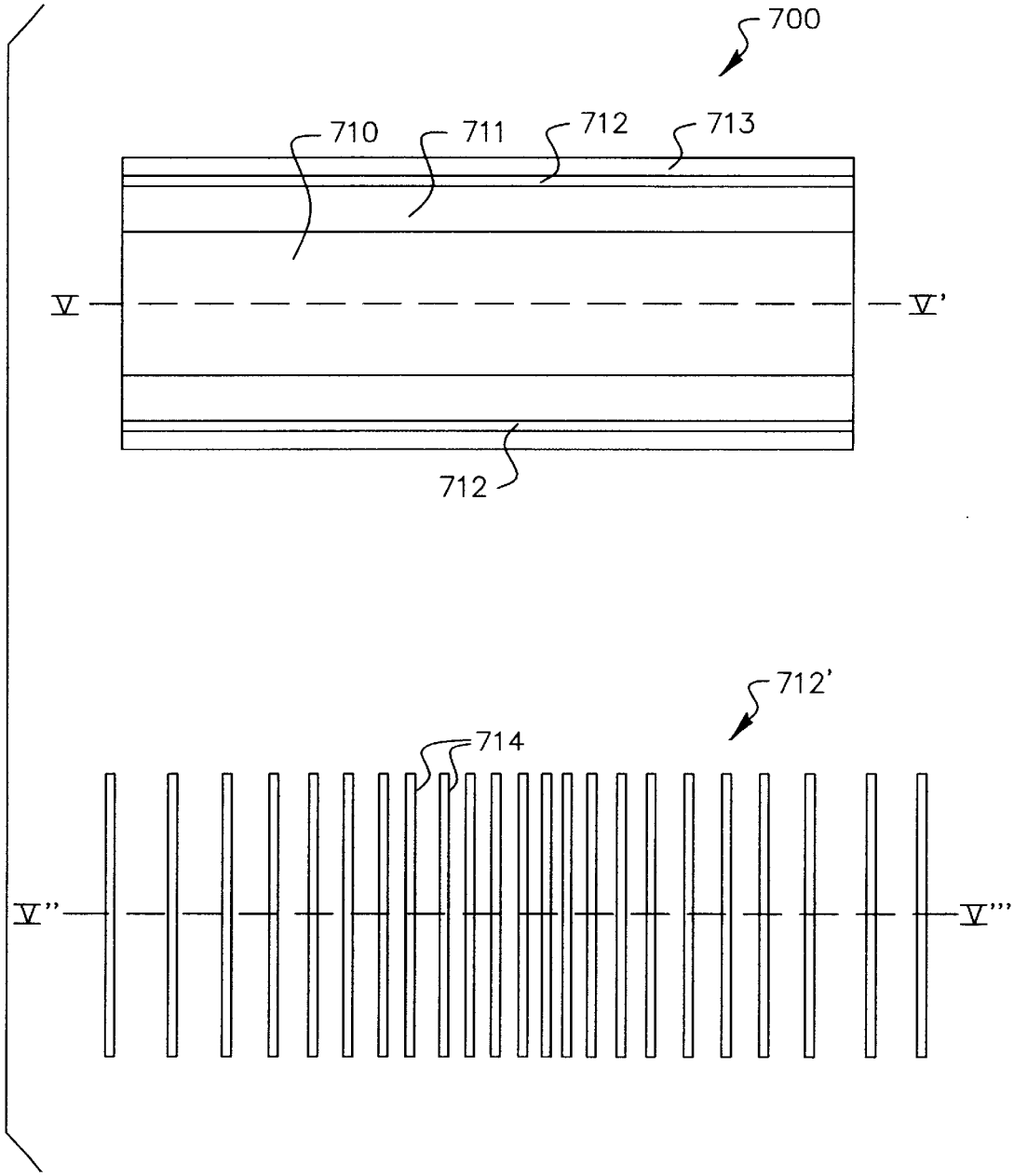
FIG. 11 shows a diagrammatic representation of a roller according to this invention, having a stiffening layer which includes a cordage in which the cordage density is variable along the length of the roller.

In yet another embodiment utilizing a variably stiff stiffening layer, the stiffening layer of a roller of a fusing station according to the invention includes a cordage, and the variation of stiffness is produced by a systematic variation, as measured in the plane of the stiffening layer, of the density of the cordage, i.e., of the number of cords per unit length cutting a direction parallel to the axis of rotation of the roller. It is preferred that the cordage density be lowest near the ends of an inventive roller, and highest substantially midway along the length of the roller. As a result, when the roller is engaged in the fusing nip, there will be an increased amount of overdrive provided by larger amount of strain in the stiffening layer near the edges of a paper sheet, as compared to the center of the paper, thereby providing a mechanism to ensure that all portions of the paper sheet spend substantially the same time passing through the nip. In this embodiment, the cordage can include natural or synthetic fibers, metal wires or strips, or any other suitable material, e.g., in the form of a wound filament which can for example be wound as a continuous strand around a compliant layer, or provided in ring form around the compliant layer as a set of rings having their centers substantially concentric with the axis of rotation of the roller. FIG. 11 shows a longitudinal cross section of a diagrammatic representation of an exemplary inventive cylindrically symmetric roller, indicated as 700, having a stiffening layer 712 which includes a cordage in which the cordage density is systematically variable along the length of the roller parallel to the roller axis. Roller 700 includes a rigid core member 710, a compliant base cushion layer 711 formed on the core member, a stiffening layer 712 surrounding and in intimate contact with the base cushion layer 711, the stiffening layer 712 including a cordage density variable in a direction parallel to the roller axis of rotation indicated by V-V', and an outer compliant layer 713 on the stiffening layer. For clarity of understanding, an embodiment of a stiffening layer 712' including a cordage is depicted in a side view representation in FIG. 11, with individual rings of cordage depicted edge on labeled 714, the rings of cordage being centered on an axis V"-V'" and having a density varying, in a direction parallel to axis V"-V'", from a minimum value at or near each end of the stiffening layer 712' to a maximum value located at substantially the midpoint along the length of the stiffening layer. For clarity, a greatly reduced cordage density 714 is indicated in FIG. 11. For an inventive fuser roller, it is preferred that diameters of the fibers, threads or wires of which the cordage is made be small enough to produce no measurable effect on fusing uniformity. Similarly, it is preferred for an inventive fuser roller that the cordage density is made high enough, and the interstices between the fibers, threads or wires of which the cordage is made be small enough, to produce no measurable effect on fusing uniformity. It is to be understood that, in other suitable embodiments of the stiffening layer 712 (not illustrated) the cordage can include any suitable winding around the base cushion layer 711, in any suitable directions, and there can also be crossings of the windings, including more than one layer. The cordage can be made of one or more different kinds of fibers, threads or wires. Alternatively, the cordage can be made of interspersed fibers, threads or wires having one or more different diameters. The longitudinal variation of the cordage density along the length of the stiffening layer can be smooth, as shown for example by the cordage 712', or it can have more or less abrupt changes. For example, individual longitudinal lengths or sections having discretely different cordage densities, with the cordage in each of the lengths in the form of continuous windings, can be used to make layer 712. The individual longitudinal lengths need not be joined but can be separated by gaps, the gaps being preferably small enough so as to cause no noticeable effects at the exterior surface of compliant layer 713 that could result in a decreased fusing performance or quality. Moreover, the maximum value of the cordage density of the stiffening layer 712 can, if desired, extend for a suitable distance on either side of substantially the midpoint along the length of the roller 700. When outer compliant layer 713 is formed on the stiffening layer, the material of layer 713 can be made to penetrate and fill the interstices of the cordage. Alternatively, the interstices of the cordage included in the stiffening layer can be filled by any suitable other material, preferably a compliant material, and this is preferably done before the outer compliant layer 713 is formed on the stiffening layer 712.

Figure 12:
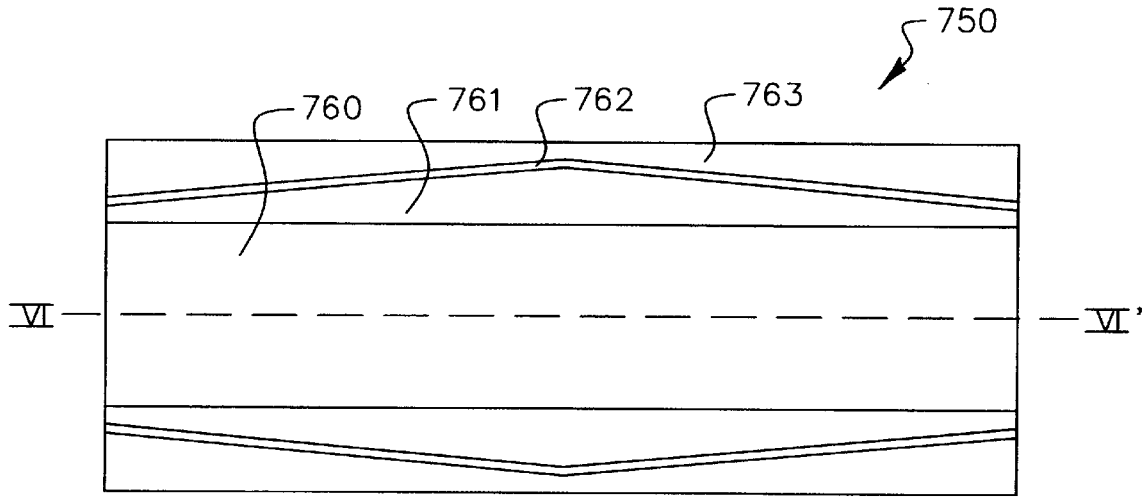
FIG. 12 shows a diagrammatic representation of a roller according to this invention, provided with a stiffening layer having a depth within the roller that varies in a direction parallel to the roller axis.

In an additional embodiment for providing a predetermined variation of overdrive along the length of a roller of an inventive fusing station, the roller can be provided with a stiffening layer which is located at different depths along the length of the roller. It is preferred that the stiffening layer is located deepest near each end of the roller, and shallowest substantially midway along the length of the roller. As a result, when the roller is engaged in the fusing nip, there will be an increased amount of overdrive provided by larger amount of strain in the stiffening layer near the edges of a paper sheet, as compared to the center of the paper, thereby providing a mechanism to ensure that all portions of a paper sheet spend substantially the same time passing through the nip. FIG. 12 shows a longitudinal cross section of a diagrammatic representation of an exemplary inventive cylindrically symmetric roller, indicated as 750, provided with a stiffening layer 762 having a depth within roller 750 that varies systematically in a direction parallel to the roller axis. Roller 750 includes a rigid core member 760, a compliant base cushion layer 761 formed on the core member, a stiffening layer 762 surrounding and in intimate contact with the base cushion layer 761 with the stiffening layer 762 having a depth which is variable in a direction parallel to an axis of rotation indicated by VI-VI', and an outer compliant layer 763 on the stiffening layer. Stiffening layer 762 is shown at a depth below the compliant layer increasing from a minimum value at or near each end of the roller 750 towards a maximum value located at substantially the midpoint along the length of the roller. Preferably, a sum of the thicknesses of layers 761 and 763 is substantially constant along the entire length of the roller. For clarity of understanding in FIG. 12, the variation of depth of stiffening layer 762 has been greatly exaggerated along the entire length of the roller 750. The longitudinal variation of depth of stiffening layer 762 can be smooth from an end of the roller 750 to substantially the midpoint, as depicted in FIG. 12, or it can have more or less abrupt changes. For example, individual longitudinal lengths or sections having discretely different depths below the outer compliant layer 763 can be used to make layer 762. The individual longitudinal lengths need not be joined to form a continuous tube but can be in the form of individual tubes, made, e.g., of metal, having different diameters, the tubes being separated by gaps, the gaps being preferably small enough so as to cause no noticeable effects at the exterior surface of compliant layer 763 that could result in a decreased fusing performance or quality. Moreover, the maximum value of the depth of stiffening layer 762 can, if desired, extend for a suitable distance on either side of substantially the midpoint along the length of the roller 750. The stiffening layer 762 having a variable depth can also include a mesh or a cordage (not illustrated).

Figure 13:
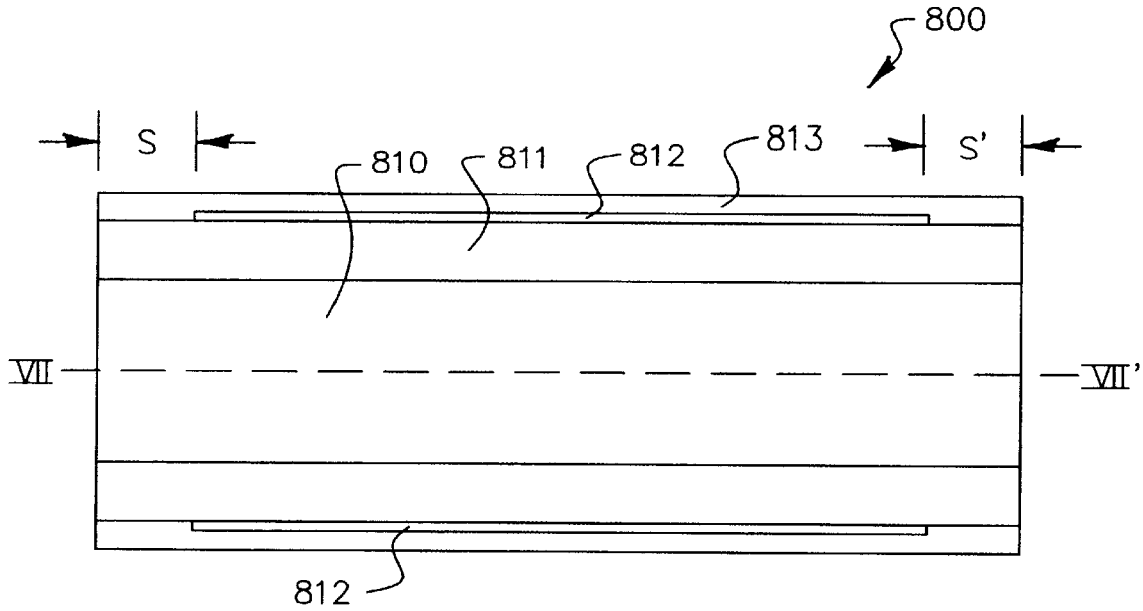
FIG. 13 shows a diagrammatic representation of a roller of an inventive fusing station, the roller including a stiffening layer which is shorter than the length of a receiver, as measured parallel to the fuser roller axis.

In a further additional embodiment for providing a predetermined variation of overdrive along the length of a roller of an inventive fusing station, the roller includes a stiffening layer which is shorter than the length of a receiver, as measured parallel to the fuser roller axis. Each edge of a paper sheet passing through the fusing station is preferably located less than about 2 inches beyond a corresponding end of the stiffening layer, and more preferably, less than about 1.5 inches beyond a corresponding end of the stiffening layer. By providing the stiffening layer to be shorter than the length of the fuser roller that contacts the paper, the overdrive is increased in the areas near the edges of a paper sheet for which there is no stiffening layer, as compared to rest of the paper, thereby providing a mechanism to reduce wrinkling of a paper sheet passing through the nip. FIG. 13 shows a longitudinal cross section of a diagrammatic representation of an exemplary inventive cylindrically symmetric roller, indicated as 800, rotatable about an axis VII-VII' and including a rigid core member 810, a compliant base cushion layer 811 formed on the core member, a stiffening layer 812 surrounding and in intimate contact with the base cushion layer 811, and an outer compliant layer 813 on the stiffening layer. As indicated in FIG. 13, the stiffening layer 812 is shorter than the roller 800, so that portions having indicated respective lengths s and s' located at each end of the outer surface of the base cushion layer 811 are not covered by the stiffening layer 812. Preferably, the portions of the base cushion layer 811 not covered by the stiffening layer are of approximately equal length, and these portions are covered by the outer compliant layer 813. It is preferred that an outer diameter of roller 800 be uniformly the same along the length of the roller. This can be accomplished by making the portions of the outer compliant layer 813 correspondingly thicker where there is no underlying stiffening layer 812 on top of base cushion layer 811, the base cushion layer preferably having a diameter which is uniformly the same along the length of the roller 800. Alternatively, the outer diameter of roller 800 can be made uniformly the same along the length of the roller by having the base cushion layer correspondingly thicker where there is no stiffening layer (not illustrated).

Figure 14:
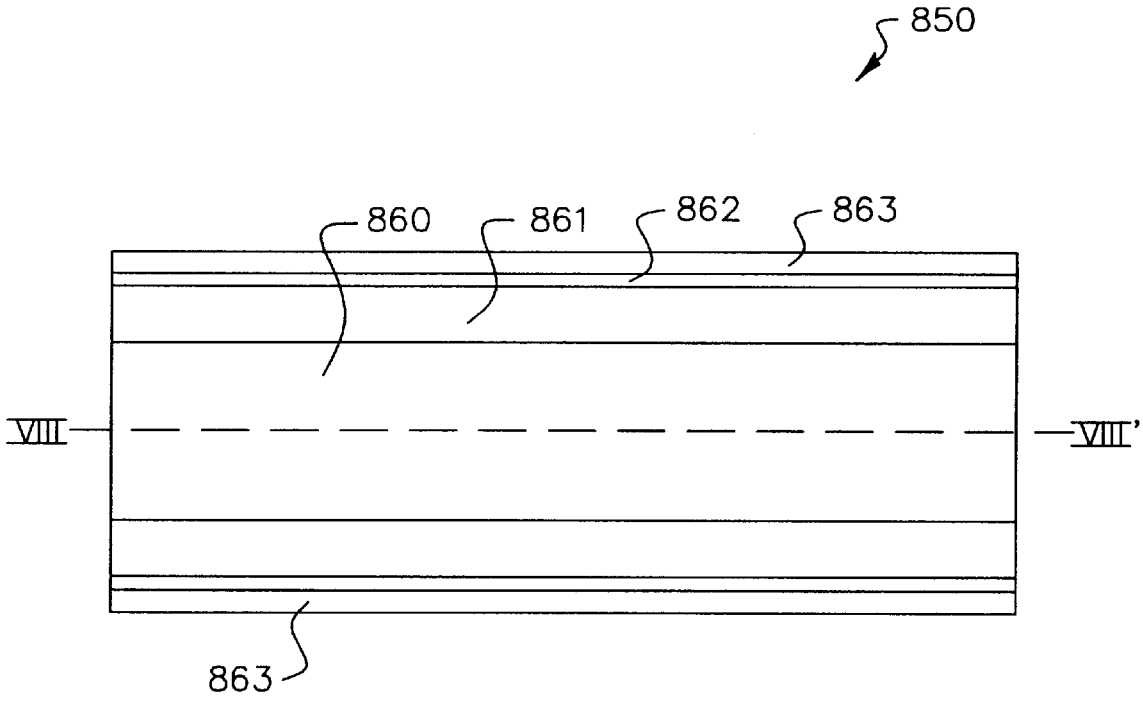
FIG. 14 shows a diagrammatic representation of a roller of an inventive fusing station, the roller having an outer diameter that varies along the length of the roller, the roller including an outer compliant layer which is thicker towards the ends of the roller than it is at substantially the midpoint along the length of the roller.

In a still further additional embodiment for providing a predetermined variation of overdrive along the length of a compliant roller of an inventive fusing station, the compliant roller including a stiffening layer can be provided with an outside diameter which varies along a direction parallel to the roller axis. It is preferred, for an inventive roller, that a maximum of the outside diameter is located near each end of the roller and a minimum is located substantially midway along the length of the roller, increasing the overdrive near the edges of a paper sheet, as compared to the center of the paper, and thereby providing a mechanism to ensure that all portions of a paper sheet spend substantially the same time passing through the nip. FIG. 14 shows a longitudinal cross section of a diagrammatic representation of an exemplary inventive cylindrically symmetric roller, indicated as 850, having a profiled outer diameter and being rotatable about an axis VIII-VIII', roller 850 including a rigid cylindrical core member 860, a compliant base cushion layer 861 formed on the core member 860, a stiffening layer 862 surrounding and in intimate contact with the base cushion layer 861, and a longitudinally profiled outer compliant layer 863 on the stiffening layer. Preferably, each of both the base cushion layer 861 and the stiffening layer 862 have a substantially uniform thickness along the length of the roller. The outer compliant layer 863 is thicker towards the ends of roller 850 than it is at substantially the midpoint along the length of the roller. It can be desirable in certain applications to vary the outer diameter of roller 850 by including a longitudinally profiled core member 860 (not illustrated) or a longitudinally profiled base cushion layer 861(not illustrated) in order to provide a desired variation of outer diameter along the length of roller 850.

Figure 5:
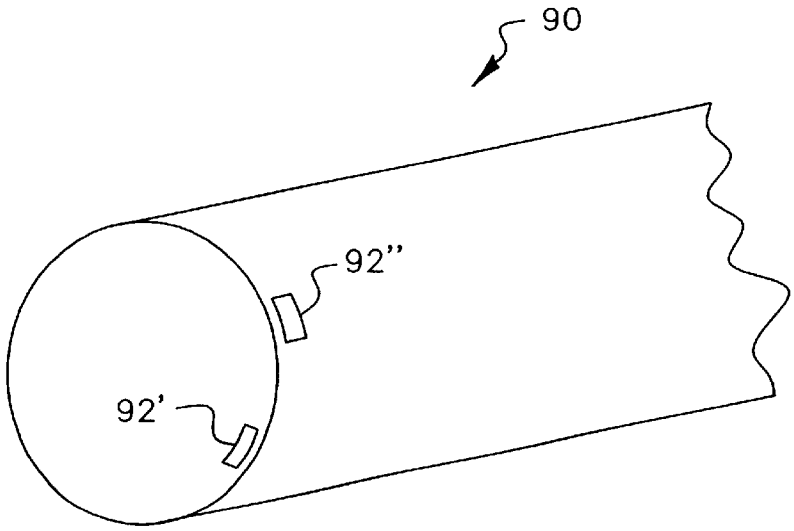
FIG. 5 is a sketch of the outside of a fuser roller having marked on its outer surface a descriptive indicia located in a small area located close to an end of the roller in accordance with the invention.
Figure 6:
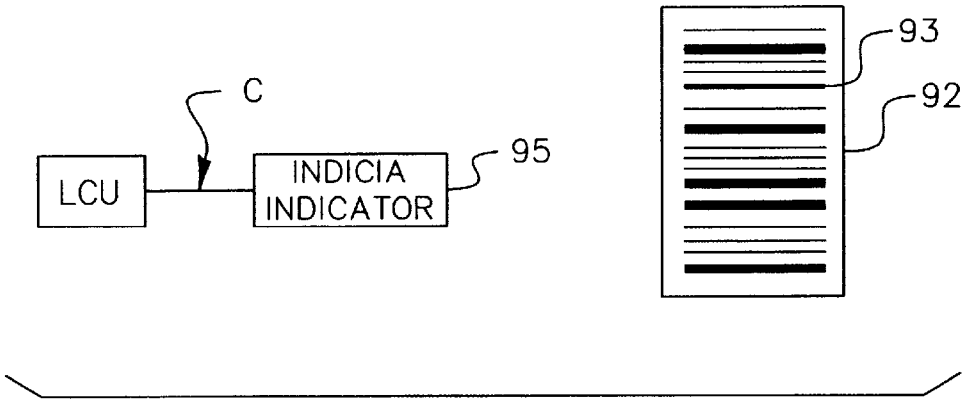
FIG. 6 is a diagrammatic representation of an indicia in the form of a bar code and its detection by an indicia indicator.

FIG. 5 diagrammatically shows an end portion of an inventive roller, indicated as 90, on which an outer surface has marked on it a set of descriptive markings or indicia which are provided to indicate a parameter (parameters) relative to the roller. The roller 90 can be representative of a fuser roller including a stiffening layer, or alternatively roller 90 can be representative of a roller utilized in a fusing station of the invention, including a pressure roller including a stiffening layer, a hard fuser roller, or a hard pressure roller. That is, it is preferred to provide an indicia on the outer surfaces of rollers 20, 20', 20", 30, 50, 50', 60 and 70 according to the manner described for an inventive roller 90. The indicia are located in a small area 92" located on a portion of the cylindrical surface close to an end of the roller. Alternatively, the indicia are contained in a small area 92' located on an end portion of the roller, with area 92' preferably near the edge or rim (the individual layers including roller 90 are not shown). FIG. 6 shows a diagrammatic representation of an area 92, an enlarged view of either of the areas 92' or 92", and illustrates that the descriptive indicia can be in the form of a bar code, as indicated by the numeral 93, which can be read, for example, by a scanner. The scanner can be mounted in an electrophotographic machine so as to monitor roller 90, e.g., during operation of the machine or during a time when the machine is idle, or the scanner can be externally provided during installation of, or during maintenance of, an inventive roller 90. Generally, the indicia can be read, sensed or detected by an indicia detector 95. As indicated in FIG. 6 by the line C, the analog or digital output of the indicia detector can be sent to a logic control unit (LCU) incorporated in an electrostatographic machine utilizing an inventive roller 90, or it can be processed externally, e.g., in a portable computer during the installation or servicing of an inventive fuser roller, or it can be processed in any other suitable data processor. The indicia can be read optically, magnetically, or by a radio frequency.

In addition to a bar code 93, the indicia can include any suitable markings, including symbols and ordinary words, and can be color coded. The indicia can also be read visually or interpreted by eye. A color coded indicia on a roller can include a relatively large colored area which can be otherwise devoid of markings or other features and which can readily be interpreted by eye to indicate a predetermined property of the color-coded roller. A thermally induced change of the indicia can be used to monitor the life of an inventive roller 90. For example, a color of an indicia of a color-coded inventive roller can be chosen to have a thermally induced slow fade rate, or a thermally induced slow rate of change of an initial, e.g., as-manufactured, color, whereby a fading or otherwise thermally induced color change can be used as a measure of elapsed life or as a measure of remaining life of the roller. Such a color change can be monitored by eye. Preferably, the color change is measured by means of a reflected light beam, e.g., by using a densitomer or spectrophotometer, or any other suitable means of measuring the intensity or color of light reflected from the indicia, with the reflected optical information provided to a LCU or other computer.

An indicia can also be utilized to measure the wear rate of an inventive roller, e.g., by providing a portion of the indicia having a predetermined wear rate. The wear rate of an indicia can be measured optically, e.g., by monitoring the reflection optical density of a portion of the indicia which can be subject to wear, or by other suitable means. Suitable materials for the indicia are for example inks, paints, magnetic materials, reflective materials, and the like, which can be applied directly to the surface of the roller.

Alternatively, the indicia can be located on a label that is adhered to the outer surface of the roller. The indicia can also be in raised form or produced by stamping with a die or by otherwise deforming a small local area on the outer surface of the roller, and the deformations can be sensed mechanically or otherwise detected or read using an indicia detector 95 in the form of a contacting probe or by other mechanical mechanisms.

Different types of information can be encoded or recorded in the indicia. For example, the outside diameter of a roller can be recorded so that nip width parameters can be accordingly adjusted. For example, the operating temperature range and operating fusing nip pressure can be recorded in the indicia. The date of manufacture of the roller can be recorded in the indicia for diagnostic purposes, so that the end of useful life of the roller could be estimated for timely replacement. Specific information for each given roller regarding the roller runout, e.g., as measured after manufacture, can also be recorded in the indicia.

It will be evident that the indicia according to the invention are distinguished from information stored electronically as described by M. E. Beard et al., U.S. Pat. No. 6,016,409, which discloses a module that includes an electronically-readable memory whereby the control system of the printing apparatus reads out codes from the electronically readable memory. According to the present invention, an indicia includes a physical alteration of the surface of a roller 90 and does not include electronic information as such, even though after detection by the indicia detector 95 the detected information can be subsequently converted to electronic form, e.g., in a computer.

In accordance with the above, and in the following numbered paragraphs below, it is apparent that this invention has been described as follows:

¶1A. A conformable roller for use in a fusing station of an electrostatographic machine and having an axis of rotation, including:

a rigid cylindrically symmetric core member;

a compliant base cushion layer formed on the core member;

a stiffening layer in intimate contact with and surrounding the base cushion layer;

a compliant release layer coated on the stiffening layer; and wherein the fusing station is provided with an internally heated fuser roller.

¶1B. A conformable internally heated toner fuser roller for use in a fusing station of an electrostatographic machine and having an axis of rotation, including:

a rigid cylindrically symmetric core member;

a compliant base cushion layer formed on the core member;

a stiffening layer in intimate contact with and surrounding the base cushion layer;

a compliant release layer coated on the stiffening layer; and a heat source located beneath an outer surface of the roller.

¶1C. A conformable pressure roller for use in a fusing station of an electrostatographic machine and having an axis of rotation, including:

a rigid cylindrically symmetric core member;

a compliant base cushion layer formed on the core member;

a stiffening layer in intimate contact with and surrounding the base cushion layer;

a compliant release layer coated on the stiffening layer; and wherein the fusing station is provided with an internally heated fuser roller.

¶2. The toner fuser roller according to Paragraph 1B wherein the core member further includes a thermally conductive material, and the heat source is located within an internal chamber of the core and is an electrically resistive element which is ohmically heated by passing electrical current through it.

¶3. The roller according to Paragraph 1A wherein the base cushion layer includes a poly(dimethylsiloxane) elastomer.

¶4. The roller according to Paragraph 1B wherein the base cushion layer has a thickness in a range of 0.25 mm to 7.5 mm.

¶5. The roller according to Paragraph 4 wherein the base cushion layer has a thickness in a range of 2.5 mm to 5 mm.

¶6. The toner fuser roller according to Paragraph 1B wherein the compliant base cushion layer has a thermal conductivity in a range 0.08 BTU/hr/ft/° F.–0.7 BTU/hr/ft/° F.

¶7. The toner fuser roller according to Paragraph 6 wherein the compliant base cushion layer has a thermal conductivity in a range 0.2 BTU/hr/ft/° F.–0.5 BTU/hr/ft/° F.

¶8. The roller according to Paragraph 1B wherein the base cushion layer has a Young's modulus in a range of 0.05 MPa–10 MPa.

¶9. The roller according to Paragraph 8 wherein the base cushion layer has a Young's modulus in a range of 0.1 MPa–1 MPa.

¶10. The toner fuser roller according to Paragraph 1B wherein the base cushion layer further includes a particulate filler.

¶11. The toner fuser roller according to Paragraph 10 wherein the particulate filler in the base cushion layer is selected from the group consisting of chromium (III) oxide, aluminum oxide, iron oxide, calcium oxide, magnesium oxide, nickel oxide, tin oxide, zinc oxide, copper oxide, titanium oxide, silicon oxide and mixtures thereof ¶12. The toner fuser roller according to Paragraph 11 wherein the particulate filler in the base cushion layer is zinc oxide.

¶13. The toner fuser roller according to Paragraph 10 wherein said particulate filler includes 5 to 50 volume percent of said base cushion layer.

¶14. The toner fuser roller according to Paragraph 13 wherein the filler includes 10 to 35 volume percent of said base cushion layer.

¶15. The toner fuser roller according to Paragraph 10 wherein said particulate filler includes particles having a mean diameter in a range of 0.1 micrometer–100 micrometers.

¶16. The toner fuser roller according to Paragraph 15 wherein the filler includes particles having a mean diameter in a range of 0.5 micrometer–40 micrometers.

¶17. The roller according to Paragraph 1A wherein said stiffening layer has a thickness in a range of 10 micrometers–500 micrometers.

¶18. The roller according to Paragraph 17 wherein said stiffening layer has a thickness in a range of 75 micrometers–250 micrometers.

¶19. The roller according to Paragraph 1A wherein said stiffening layer has a Young's modulus in a range of 0.25 GPa–500 GPa.

¶20. The roller according to Paragraph 19 wherein said stiffening layer has a Young's modulus in a range of 10 GPa–300 GPa.

¶21. The roller according to Paragraph 1A wherein said stiffening layer is selected from one or more metals of a group consisting of nickel, copper, gold, and steel.

¶22. The roller according to Paragraph 21 wherein the stiffening layer is made of nickel.

¶23. The roller according to Paragraph 1A wherein the release layer includes a fluoroelastomer or a silicone rubber.

¶24. The roller according to Paragraph 1A wherein the release layer has a thickness less than 500 micrometers.

¶25. The roller according to Paragraph 24 wherein said release layer has a thickness in a range of 25 micrometers to 250 micrometers.

¶26. The toner fuser roller according to Paragraph 1B wherein the compliant release layer has a thermal conductivity in a range of 0.08 BTU/hr/ft/° F.–0.7 BTU/hr/ft/° F.

¶27. The toner fuser roller according to Paragraph 26 wherein the compliant release layer has a thermal conductivity in a range of 0.2 BTU/hr/ft/° F.–0.5 BTU/hr/ft/° F.

¶28. The roller according to Paragraph 1A wherein the release layer has a Young's modulus in a range of 0.05 MPa–10 MPa.

¶29. The roller according to Paragraph 28 wherein the release layer has a Young's modulus in a range of 0.1 MPa–1 MPa.

¶30. The toner fuser roller according to Paragraph 1B wherein the compliant release layer further includes a particulate filler.

¶31. The toner fuser roller according to Paragraph 30 wherein the particulate filler in the release layer is selected from the group consisting of aluminum oxide, iron oxide, calcium oxide, magnesium oxide, nickel oxide, tin oxide, zinc oxide, copper oxide, titanium oxide, silicon oxide, graphite, and mixtures thereof.

¶32. The toner fuser roller according to Paragraph 29 wherein the particulate filler in the release layer is zinc oxide.

¶33. The toner fuser roller according to Paragraph 30 wherein the particulate filler includes 5 to 50 volume percent of the release layer.

¶34. The toner fuser roller according to Paragraph 33 wherein the filler includes 10 to 35 volume percent of the release layer.

¶35. The toner fuser roller of Paragraph 1B further including a thin barrier layer coated on the stiffening layer.

¶36. The toner fuser roller of Paragraph 35 wherein the thin barrier layer includes a fluoroelastomer.

¶37. The toner fuser roller of Paragraph 35 wherein said barrier layer has a thickness in a range of 10 micrometers to 50 micrometers.

¶38. The toner fuser roller of Paragraph 1B wherein the stiffening layer is electrically resistive and the heat source includes ohmic heating of the stiffening layer by passing electrical current through it.

¶39. The toner fuser roller of Paragraph 1B wherein the stiffening layer includes an electrically resistive printed circuit on its surface and the heat source includes ohmic heating of the printed circuit.

¶40. The toner fuser roller of Paragraph 1B wherein the heat source includes ohmic heating of an array of one or more electrically resistive wires located within or in close proximity to the stiffening layer.

¶41. The toner fuser roller according to Paragraph 1B wherein the heat source includes an electrically resistive element located inside the core member, the core member being tubular and thermally conductive, the resistive element being ohmically heated by passing electrical current through it.

¶42. The toner fuser roller according to Paragraph 41 wherein the electrically resistive element is included in an axially centered tubular incandescent heating lamp.

¶43A. The toner fuser roller according to Paragraph 38 wherein the heat source is controlled by a feedback circuit.

¶43B. The toner fuser roller according to Paragraph 39 wherein the heat source is controlled by a feedback circuit.

¶43C. The toner fuser roller according to Paragraph 40 wherein the heat source is controlled by a feedback circuit.

¶43D. The toner fuser roller according to Paragraph 41 wherein the heat source is controlled by a feedback circuit.

¶43E. The toner fuser roller according to Paragraph 42 wherein the heat source is controlled by a feedback circuit.

¶44. A simplex fusing station of an electrostatographic machine, including:

a rotating internally heated compliant fuser roller;

a counter-rotating hard pressure roller engaged to form a fusing nip with the compliant fuser roller; and wherein the compliant fuser roller further includes a base cushion layer surrounding a rigid cylindrical core member, a stiffening layer in intimate contact with the base cushion layer, the stiffening layer having a Young's modulus in a range of 0.1 GPa to 500 GPa and having a thickness less than 500 micrometers, and an outer compliant layer surrounding the stiffening layer.

¶45. A simplex fusing station of an electrostatographic machine, including:

a rotating internally heated compliant fuser roller;

a counter-rotating compliant pressure roller engaged to form a fusing nip with the compliant fuser roller;

wherein the compliant fuser roller further includes a base cushion layer surrounding a rigid cylindrical core member, a stiffening layer in intimate contact with the base cushion layer, the stiffening layer having a Young's modulus in a range of 0.1 GPa to 500 GPa and having a thickness less than 500 micrometers, and an outer compliant release layer surrounding the stiffening layer; and wherein also the compliant pressure roller further includes a base cushion layer surrounding a rigid cylindrical core member, a stiffening layer in intimate contact with the base cushion layer, the stiffening layer having a Young's modulus in a range of 0.1 GPa to 500 GPa and having a thickness less than 500 micrometers, and an optional outer compliant layer surrounding the stiffening layer.

¶46. A simplex fusing station of an electrostatographic machine, including:

a rotating internally heated compliant pressure roller;

a counter-rotating hard fuser roller engaged to form a fusing nip with the compliant pressure roller; and wherein the compliant pressure roller further includes a base cushion layer surrounding a rigid cylindrical core member, a stiffening layer in intimate contact with the base cushion layer, the stiffening layer having a Young's modulus in a range of 0.1 GPa to 500 GPa and having a thickness less than 500 micrometers, and an optional outer compliant layer surrounding the stiffening layer.

¶47A. The simplex fusing station according to Paragraph 44 wherein the stiffening layer is in the form of a seamless tube.

¶47B. The simplex fusing station according to Paragraph 45 wherein the stiffening layer is in the form of a seamless tube.

¶47C. The simplex fusing station according to Paragraph 46 wherein the stiffening layer of the fuser roller and wherein the stiffening layer of the pressure roller each has the form of a seamless tube.

¶48. A duplex fusing station of an electrostatographic machine, including:

a rotating first fuser roller;

a counter-rotating second fuser roller engaged to form a pressure fusing nip with the first fuser roller;

wherein both or either of the first and second fuser rollers further includes a base cushion layer surrounding a rigid cylindrical core member, a stiffening layer in intimate contact with the base cushion layer, the stiffening layer having a Young's modulus in a range of 0.1 GPa to 500 GPa and having a thickness less than 500 micrometers, and an outer compliant release layer surrounding the stiffening layer; and wherein also both or either of the first and second fuser rollers is heated by an internal source of heat.

¶49. A toner fusing method, for use in an electrostatographic machine, including:

forming a fusing nip by engaging a rotating compliant fuser roller having an internal source of heat and a counter-rotating hard pressure roller, one of the rollers being a driven roller and the other frictionally driven by pressure contact in the nip;

forming an unfused toner image on a surface of a receiver sheet;

feeding the leading edge of the receiver into the nip and allowing the unfused toner image on the receiver sheet to pass through the fusing nip with the unfused toner image facing the fuser roller; and wherein the fuser roller having an internal source of heat further includes a rigid cylindrical core member, a compliant base cushion layer formed on the core member, a stiffening layer in intimate contact with and surrounding the base cushion layer, and an outer compliant layer coated on the stiffening layer, the source of heat required for toner fusing being located beneath the surface of the roller.

¶50. The toner fusing method of Paragraph 49 wherein:

the compliant base cushion layer includes an elastomer and contains 5 to 50 volume percent of a particulate filler having a particle size in a range of 0.1 micrometer to 100 micrometers, the base cushion layer further including a thickness in a range of 0.25 mm to 7.5 mm, a thermal conductivity in a range of 0.08 to 0.7 BTU/hr/ft/° F., and a Young's modulus in a range of 0.05 MPa to 10 MPa;

the stiffening layer includes a flexible material having a thickness in a range of 10 micrometers to 500 micrometers and a Young's modulus in a range of 0.5 GPa to 500 GPa; and the outer compliant layer includes an elastomer and contains 5 to 50 volume percent of a particulate filler having a particle size in a range of 0.1 micrometer to 100 micrometers, the compliant release layer further including a thickness in a range of 10 micrometers to 50 micrometers, a thermal conductivity in a range of 0.08 to 0.7 BTU/hr/ft/° F., and a Young's modulus in a range of 0.05 MPa to 10 MPa.

¶51. The toner fusing method according to Paragraph 49 wherein said outer compliant layer includes a fluoroelastomer or a silicone rubber.

¶52. The toner fusing method according to Paragraph 49 wherein said compliant base cushion layer includes a poly (dimethylsiloxane) elastomer and a zinc oxide filler.

¶53. The toner fusing method according to Paragraph 49 wherein the stiffening layer is made of nickel.

¶54. The toner fusing method according to Paragraph 49 wherein the core member is thermally conductive and further includes a hollow internal chamber, the internal source of heat being located within the internal chamber and including an electrically resistive element which is ohmically heated by passing electrical current through it.

¶55. The toner fusing method of Paragraph 49 wherein the stiffening layer is electrically resistive and the internal source of heat includes ohmic heating of the stiffening layer by passing electrical current through it.

¶56. The toner fusing method of Paragraph 49 wherein the stiffening layer includes an electrically resistive printed circuit on its surface and the internal source of heat includes ohmic heating of the printed circuit.

¶57. The toner fusing method of Paragraph 49 wherein the internal source of heat includes ohmic heating of an array of one or more electrically resistive wires located within or in close proximity to the stiffening layer.

¶58. The toner fusing method of Paragraph 54 wherein the electrically resistive element is included in an axially centered tubular incandescent heating lamp.

¶59A. The toner fusing method of Paragraph 54 wherein the heat source is controlled by a feedback circuit.

¶59B. The toner fusing method of Paragraph 55 wherein the heat source is controlled by a feedback circuit.

¶59C. The toner fusing method of Paragraph 56 wherein the heat source is controlled by a feedback circuit.

¶59D. The toner fusing method of Paragraph 57 wherein the heat source is controlled by a feedback circuit.

¶59E. The toner fusing method of Paragraph 58 wherein the heat source is controlled by a feedback circuit.

¶60. A toner fusing method, for use in an electrostatographic machine, including:

forming a fusing nip by engaging a rotating hard fuser roller having an internal source of heat and a counter-rotating compliant pressure roller, one of the rollers being a driven roller and the other frictionally driven by pressure contact in the nip;

forming an unfused toner image on a surface of a receiver sheet;

feeding the leading edge of the receiver into the nip and allowing the unfused toner image on the receiver sheet to pass through the fusing nip with the unfused toner image facing the fuser roller; and wherein the pressure roller includes a rigid cylindrical core member, a compliant base cushion layer formed on the core member, and a stiffening layer in intimate contact with and surrounding the base cushion layer.

¶61. The toner fusing method of Paragraph 60 wherein:

the compliant base cushion layer of the pressure roller includes an elastomer having a thickness in a range of 0.25 mm to 25 mm, and having a Young's modulus in a range of 0.05 MPa to 10 MPa; and the stiffening layer includes a flexible material having a thickness in a range of 10 micrometers to 500 micrometers and having a Young's modulus in a range of 0.5 GPa to 500 GPa.

¶62. The toner fusing method according to Paragraph 60 wherein said compliant base cushion layer includes a poly (dimethylsiloxane) elastomer.

¶63. The toner fusing method according to Paragraph 60 wherein the stiffening layer is made of nickel.

¶64. The toner fusing method according to Paragraph 60 wherein the pressure roller further includes an optional outer compliant layer coated on the stiffening layer, the outer compliant layer including an elastomer having a thickness less than 500 micrometers, and having a Young's modulus in a range of 0.05 MPa–10 MPa.

¶65. The toner fusing method according to Paragraph 60 wherein the hard fuser roller is thermally conductive and further includes a hollow internal chamber, the internal source of heat being located within the internal chamber and including an electrically resistive element which is ohmically heated by passing electrical current through it.

¶66. The toner fusing method of Paragraph 60 wherein the hard fuser roller further includes an outer release layer having a thickness less than 1.25 mm, the release layer further including a silicone rubber or a fluoroelastomer.

¶67A. The fusing station of Paragraph 45 wherein the base cushion layer of the pressure roller has a Poisson's ratio in a range from 0.2 to 0.5.

¶67B. The fusing station of Paragraph 46 wherein the base cushion layer of the pressure roller has a Poisson's ratio in a range from 0.2 to 0.5.

¶68A. The fusing station of Paragraph 67A wherein the base cushion layer of the pressure roller has a Poisson's ratio in a range from 0.45 to 0.5.

¶68B. The fusing station of Paragraph 67B wherein the base cushion layer of the pressure roller has a Poisson's ratio in a range from 0.45 to 0.5.

¶69A. The fusing station of Paragraph 44 wherein the base cushion layer of the fuser roller has a Poisson's ratio in a range from 0.2 to 0.5.

¶69B. The fusing station of Paragraph 46 wherein the base cushion layer of the fuser roller has a Poisson's ratio in a range from 0.2 to 0.5.

¶70A. The fusing stations of Paragraph 69A wherein the base cushion layer of the fuser rollers has a Poisson's ratio in a range from 0.45 to 0.5.

¶70B. The fusing stations of Paragraph 69B wherein the base cushion layer of the fuser rollers has a Poisson's ratio in a range from 0.45 to 0.5.

¶71A. The fusing station of Paragraph 44 wherein the Poisson's ratio of the outer compliant layer is between 0.4 and 0.5.

¶71B. The fusing station of Paragraph 45 wherein the Poisson's ratio of the outer compliant layer is between 0.4 and 0.5.

¶71C. The fusing station of Paragraph 46 wherein the Poisson's ratio of the outer compliant layer of the fusing roller and wherein the Poisson's ratio of the outer compliant layer of the fusing roller each has a value between 0.4 and 0.5.

¶71D. The fusing station of Paragraph 48 wherein the Poisson's ratio of the outer compliant layer of each fuser roller is between 0.4 and 0.5.

¶72A. The fusing station of Paragraph 71A wherein the Poisson's ratio of the outer compliant layer is between 0.45 and 0.5.

¶72B. The fusing station of Paragraph 71B wherein the Poisson's ratio of the outer compliant layers is between 0.45 and 0.5.

¶72C. The fusing station of Paragraph 46 wherein the Poisson's ratio of the outer compliant layer of the fusing roller and wherein the Poisson's ratio of the outer compliant layer of the fusing roller each has a value between 0.4 and 0.5.

¶72D. The fusing station of Paragraph 71D wherein the Poisson's ratio of the outer compliant layer of each fuser roller is between 0.45 and 0.5.

¶73. The toner fusing method of Paragraph 49 wherein the base cushion layer has a Poisson's ratio in a range from 0.2 to 0.5.

¶74. The toner fusing method of Paragraph 60 wherein the base cushion layer has a Poisson's ratio in a range from 0.2 to 0.5.

¶75A. The toner fusing method of Paragraph 73 wherein the base cushion layer has a Poisson's ratio in a range from 0.45 to 0.5.

¶75B. The toner fusing method of Paragraph 74 wherein the base cushion layer has a Poisson's ratio in a range from 0.45 to 0.5.

¶76A. The toner fusing method of Paragraph 49 wherein the outer compliant layer has a Poisson's ratio in a range from 0.4 to 0.5.

¶76B. The toner fusing method of Paragraph 60 wherein the outer compliant layer has a Poisson's ratio in a range from 0.4 to 0.5.

¶77A. The toner fusing method of Paragraph 76A wherein the outer compliant layer has a Poisson's ratio in a range from 0.45 to 0.5.

¶77B. The toner fusing method of Paragraph 76B wherein the outer compliant layer has a Poisson's ratio in a range from 0.45 to 0.5.

¶78. The toner fuser roller of Paragraph 1B wherein the release layer has a roughness value, Ra, not exceeding about 10 microinches.

¶79. The simplex fusing station according to Paragraph 44 wherein the hard pressure roller includes a rigid cylindrical tube, optionally coated with an elastomer less than 1.25 mm thick including a fluoroelastomer or a silicone rubber.

¶80. The simplex fusing station according to Paragraph 44 wherein the hard fuser roller includes a thermally conductive rigid cylindrical tube, optionally coated with an elastomer less than 1.25 mm thick including a fluoroelastomer or a silicone rubber.

¶81. The toner fusing method according to Paragraph 49 wherein the hard pressure roller includes a rigid cylindrical tube, optionally coated with an elastomer less than 1.25 mm thick including a fluoroelastomer or a silicone rubber.

¶82. The toner fusing method according to Paragraph 61 wherein the hard fuser roller includes a thermally conductive rigid cylindrical tube, optionally coated with an elastomer less than 1.25 mm thick including a fluoroelastomer or a silicone rubber.

¶83. The roller according to Paragraph 1A wherein the stiffening layer has an axial variation of stiffness, the stiffness being measured parallel to a tangential direction of rotation of the roller, with the magnitude of said stiffness varying in a direction parallel to the roller axis.

¶84. The roller according to Paragraph 83 wherein the variation of stiffness is substantially symmetric about the midpoint of the roller as measured along the length of the roller.

¶85. The roller according to Paragraph 83 wherein the variation of stiffness is produced by a variation of thickness of the stiffening layer.

¶86. The roller according to Paragraph 85 wherein the thickness is smaller near the ends of the roller than at the midpoint of the roller.

¶87. The roller according to Paragraph 83 wherein the variation of stiffness is produced by a variation of the Young's modulus of the stiffening layer.

¶88. The roller according to Paragraph 87 wherein the Young's modulus has a smaller magnitude near each end of the roller than at the midpoint of the roller.

¶89. The roller according to Paragraph 83 wherein the variation of stiffness is produced by providing a plethora of holes in the stiffening layer, the area per unit length occupied by holes varying along the length of the roller.

¶90. The roller according to Paragraph 89 wherein there is more area occupied by holes, per unit area of the stiffening layer, near the ends of the roller than at the midpoint of the roller.

¶91. The roller according to Paragraph 83 wherein the variation of stiffness is produced by providing a stiffening layer in the form of a mesh or fabric in which the mesh density or fabric density is variable along the length of the roller.

¶92. The roller according to Paragraph 91 wherein the mesh or fabric density is lower near the ends of the roller than at the midpoint of the roller.

¶93. The roller according to Paragraph 83 wherein the stiffening layer includes a cordage and the variation of stiffness is produced by a variation in the number of cords per unit length along the roller, as measured axially in the plane of the stiffening layer, of the number of cords per unit length cutting a direction parallel to the axis of rotation of the roller.

¶94. The roller according to Paragraph 93 wherein the number of cords per unit length is largest substantially half way along the length of the roller and smallest near each end of the roller.

¶95. The roller according to Paragraph 1A having a variable bending stiffness that varies along a direction parallel to the roller axis.

¶96. The roller according to Paragraph 95 wherein said variable bending stiffness has a minimum value located substantially at the midpoint along the length of the roller, and has maximum values near the ends of the roller.

¶97. The roller according to Paragraph 1A wherein the outside diameter varies along a direction parallel to the roller axis.

¶98. The roller according to Paragraph 97 wherein a maximum of said outside diameter is located near each end of the roller and a minimum is located substantially half way along the length of the roller.

¶99. The roller according to Paragraph 1A wherein the stiffening layer is located at a depth below the outer surface which varies along the length of the roller.

¶100. The roller according to Paragraph 99 wherein the depth is greatest near each end of the roller and is smallest substantially half way along the length of the roller.

¶101. The roller according to Paragraph 1A wherein the core member has an outside diameter that varies along a direction parallel to the roller axis.

¶102. The roller according to Paragraph 101 wherein the outer diameter of the core is a minimum substantially half way along the length of the roller and becomes gradually larger towards each end of the roller.

¶103. The roller according to Paragraph 102 wherein the outer diameter of the base cushion layer is substantially the same along the length of the roller.

¶104. The roller according to Paragraph 103 wherein the stiffening layer and the outer compliant layer each has a substantially uniform thickness along the length of the roller.

¶105. The fuser roller according to Paragraph 1B, wherein the stiffening layer is shorter than the length of a receiver, as measured parallel to the roller axis, when the said fuser roller is being utilized for fusing a toner image to the receiver.

¶106. The fuser roller according to Paragraph 104, wherein said receiver has edges perpendicular to the axis of rotation, each one of said edges being located less than about 2 inches beyond a corresponding end of the stiffening layer.

¶107. The fuser roller according to Paragraph 105 wherein each one of said edges is located less than about 1.5 inches beyond a corresponding end of the stiffening layer.

The invention has been described in detail with particular reference to certain preferred embodiments thereof, but it will be understood that variations and modifications will be obvious to those skilled within the relevant arts, therefore, the scope of the invention should be measured by the appended claims.

What is claimed is:

1. A conformable fuser roller for use in a fusing station of an electrostatographic machine, comprising:

a rigid cylindrical core member centered on an axis of rotation;

a compliant base cushion layer formed on the core member;

a stiffening layer in intimate contact with and surrounding the base cushion layer; and wherein the fusing roller is internally heated.

2. The conformable roller of claim 1 further comprising a heat source located beneath an outer surface of the roller.

3. The conformable roller of claim 1 further comprising a compliant release layer coated on the stiffening layer.

4. The conformable roller of claim 1 wherein the conformable roller is in juxtaposition with a counter-rotating hard pressure roller to form a fusing nip.

5. The conformable roller of claim 1 further comprising the base cushion layer having a Poisson's ratio between 0.2 and 0.5.

6. The conformable roller of claim 1 further comprising the stiffening layer having a Young's modulus in a range of 0.1 GPa to 500 GPa and having a thickness less than 500 micrometers, and an optional outer compliant layer surrounding the stiffening layer, the optional outer compliant layer having a Poisson's ratio between 0.4 and 0.5.

7. The conformable roller of claim 1 further comprising an outer compliant layer surrounding the stiffening layer, the outer compliant layer having a Poisson's ratio between 0.4 and 0.5.

8. The conformable roller of claim 1 wherein the conformable roller is used within a duplex fusing station having a counter-rotating second fuser roller engaged to form a pressure fusing nip with the conformable fuser roller.

9. The conformable roller of claim 8 wherein each of the fuser rollers further comprise:

the base cushion layer having a Poisson's ratio between 0.2 and 0.5 surrounding the rigid cylindrical core member, the stiffening layer in intimate contact with the base cushion layer, the stiffening layer having a Young's modulus in a range of 0.1 GPa to 500 GPa and having a thickness less than 500 micrometers, and an outer compliant release layer having a Poisson's ratio between 0.4 and 0.5, the outer compliant release layer surrounding the stiffening layer.

10. The conformable roller of claim 8 wherein at least one of the fuser rollers is internally heated.

11. The roller according to claim 1 wherein the stiffening layer has an axial variation of stiffness, the stiffness being measured parallel to a tangential direction of rotation of the roller, with the magnitude of said stiffness varying in a direction parallel to the roller axis.

12. The roller according to claim 11 wherein the variation of stiffness is substantially symmetric about the midpoint of the roller as measured along the length of the roller, and is produced by a variation of thickness of the stiffening layer such the thickness is smaller near the ends of the roller than at the midpoint of the roller.

13. The roller according to claim 11 wherein the variation of stiffness is produced by a variation of the Young's modulus of the stiffening layer such the Young's modulus has a smaller magnitude near each end of the roller than at the midpoint of the roller.

14. A method of making a toner fuser for use in an electrostatographic machine comprising the steps of:

providing a rotating fuser roller in juxtaposition to a counter-rotating pressure roller such that a fusing nip is formed between the rollers, with one of the rollers being a driving roller and the other roller frictionally driven by pressure contact in the nip with the driving roller;

further providing that the fuser roller comprises a rigid cylindrical core member with a compliant base cushion layer formed on the core member, a stiffening layer in intimate contact with and surrounding the base cushion layer, and an outer compliant layer coated on the stiffening layer; and creating a mechanism for internally heating the fuser roller.

15. The method of claim 14 wherein the step of further providing additionally comprises the compliant base cushion layer includes an elastomer and contains 5 to 50 volume percent of a particulate filler having a particle size in a range of 0.1 micrometer to 100 micrometers, the base cushion layer further comprising a thickness in a range of 0.25 mm to 7.5 mm, a thermal conductivity in a range of 0.08 to 0.7 BTU/hr/ft/° F., a Poisson's ratio between 0.2 and 0.5, a Young's modulus in a range of 0.05 MPa to 10 MPa.

16. The method of claim 14 wherein the step of further providing additionally comprises the stiffening layer having a flexible material with a thickness in a range of 10 micrometers to 500 micrometers, a Young's modulus in a range of 0.5 GPa to 500 GPa.

17. The method of claim 14 wherein the step of further providing additionally comprises the outer compliant layer comprises an elastomer containing 5 to 50 volume percent of a particulate filler having a particle size in a range of 0.1 micrometer to 100 micrometers, the outer compliant layer further comprising a thickness in a range of 10 micrometers to 50 micrometers, a thermal conductivity in a range of 0.08 to 0.7 BTU/hr/ft/° F., a Poisson's ratio between 0.4 and 0.5, and a Young's modulus in a range of 0.05 MPa to 10 MPa.

18. A product for toner fusing within an electrostatographic machine comprising the steps of:

providing a rotating hard fuser roller having an internal source of heat and a counter-rotating compliant pressure roller such that the rollers form a fusing nip, one of the rollers being a driven roller and the other frictionally driven by engagement pressure within the nip; and further providing the pressure roller with a rigid cylindrical core member, a compliant base cushion layer formed on the core member, a stiffening layer in intimate contact with and surrounding the base cushion layer, an optional outer compliant layer coated on the stiffening layer.

19. The product of claim 18 wherein the step of further providing additionally comprises:

the compliant base cushion layer of the pressure roller comprises an elastomer having a thickness in a range of 0.25 mm to 25 mm, a Poisson's ratio between 0.2 and 0.5, a Young's modulus in a range of 0.05 MPa to 10 MPa;

the stiffening layer comprises a flexible material having a thickness in a range of 10 micrometers to 500 micrometers and having a Young's modulus in a range of 0.5 GPa to 500 GPa, and wherein further the optional outer compliant layer comprises an elastomer having a thickness less than 500 micrometers, a Poisson's ratio between 0.4 and 0.5, and a Young's modulus in a range of 0.05 MPa–10 MPa.

20. The product of claim 18 wherein the further providing step further comprises the stiffening layer has an axial variation of stiffness, the stiffness being measured parallel to a tangential direction of rotation of the roller, with the magnitude of said stiffness varying in a direction parallel to the roller axis.

21. The product according to claim 20 wherein the variation of stiffness is substantially symmetric about the midpoint of the roller as measured along the length of the roller, and is produced by a variation of thickness of the stiffening layer such the thickness is smaller near the ends of the roller than at the midpoint of the roller.

22. The product according to claim 20 wherein the further providing step additionally comprises the variation of stiffness is produced by providing a plurality of holes in the stiffening layer such that there is more area occupied by holes, per unit area of the roller ends than at the roller midpoint.

23. The product according to claim 20 wherein the further providing step additionally comprises the variation of stiffness is produced by providing a stiffening layer in the form of a mesh or fabric in which the mesh density or fabric density is variable along the length of the roller, such the mesh or fabric density is lower near the ends of the roller than at the midpoint of the roller.

24. The product according to claim 20 wherein the further providing step additionally comprises the variation of stiffness is produced by a variation in the number of cords per unit length along the roller, as measured axially in the plane of the stiffening layer, of the number of cords per unit length cutting a direction parallel to the axis of rotation of the roller, such the number of cords per unit length is largest substantially half way along the length of the roller and smallest near each end of the roller.

25. The product of claim 18 wherein the providing step further comprises providing an indicia located on an outer surface of the roller; wherein the indicia are provided on the roller to indicate a parameter relative to the roller that can be read, sensed or detected by an indicia detector, either visually, electrically, mechanically, optically, magnetically, or by means of a radio frequency.

* * * * *